US012060675B2

(12) United States Patent
Youk et al.

(10) Patent No.: US 12,060,675 B2
(45) Date of Patent: Aug. 13, 2024

(54) CLOTHES FOLDING DEVICE

(71) Applicant: LG Electronics Inc., Seoul (KR)

(72) Inventors: Hyungkyu Youk, Seoul (KR); Keunjoo Kim, Seoul (KR); Sangjo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 43 days.

(21) Appl. No.: 17/909,269

(22) PCT Filed: Dec. 23, 2020

(86) PCT No.: PCT/KR2020/019023
§ 371 (c)(1),
(2) Date: Sep. 2, 2022

(87) PCT Pub. No.: WO2021/177568
PCT Pub. Date: Sep. 10, 2021

(65) Prior Publication Data

US 2023/0090927 A1 Mar. 23, 2023

(30) Foreign Application Priority Data

Mar. 4, 2020 (KR) ..... 10-2020-0027438
Mar. 4, 2020 (KR) ..... 10-2020-0027440

(51) Int. Cl.
*D06F 89/02* (2006.01)
*A41H 43/02* (2006.01)

(52) U.S. Cl.
CPC ..... *D06F 89/02* (2013.01); *A41H 43/0257* (2013.01)

(58) Field of Classification Search
CPC ..... D06F 89/02; D06F 89/00; D06F 89/005; D06F 89/023; D06F 89/026; A41H 43/0257; A41H 43/02; A41H 43/025
See application file for complete search history.

(56) References Cited

U.S. PATENT DOCUMENTS 4,093,205 A * 6/1978 Kober ..... B65H 45/04 493/425
5,172,502 A * 12/1992 Kober ..... D06F 67/04 38/143

(Continued)

FOREIGN PATENT DOCUMENTS

CN 109208302 1/2019
CN 109629215 4/2019

(Continued)

OTHER PUBLICATIONS

International Search Report in International Appln. No. PCT/KR2020/019023, dated Apr. 7, 2021, 5 pages (with English translation).

(Continued)

*Primary Examiner* — Ismael Izaguirre
(74) *Attorney, Agent, or Firm* — Fish & Richardson P.C.

(57) ABSTRACT

The present disclosure relates to a clothes folding device including: a loading assembly which causes the clothes to be pushed-in and seats the clothes on a first folding layer equipped with a conveyor for transport; a folding assembly which performs the folding of the clothes while the pushed-in clothes are transported; and an unloading assembly which is disposed below the folding assembly and loads the clothes discharged by the folding assembly. The loading assembly includes: a seating plate which forms an inclined surface at an inlet and allows the clothes to be seated thereon; a clamp assembly which fixes the clothes and moves the clothes to the first folding layer; and a transport roller which presses the clothes seated on the first folding layer and rotates together with the moving of the clothes while pressing the clothes, and thus, preventing the clothes from being separated. The clamp assembly includes a wheel assembly and a clamp plate which presses inserted clothes from both sides.

(Continued)

The wheel assembly includes a unidirectional rotating wheel which rotates together with the inserted clothes.

32 Claims, 29 Drawing Sheets

(56) References Cited

U.S. PATENT DOCUMENTS

| | | | | |
|---|---|---|---|---|
| 5,437,114 | A * | 8/1995 | Kuipers | D06F 67/04 38/143 |
| 5,743,202 | A * | 4/1998 | Price | D05B 35/102 112/306 |
| 5,924,376 | A * | 7/1999 | Olewicz | D05B 33/00 112/277 |
| 2008/0179354 | A1 | 7/2008 | Walters et al. | |
| 2015/0191867 | A1 | 7/2015 | Heinz et al. | |

FOREIGN PATENT DOCUMENTS

| | | | | |
|---|---|---|---|---|
| CN | 110382772 | A * | 10/2019 | A41H 43/0257 |
| JP | H07102278 | | 11/1995 | |
| JP | 2002119800 | | 4/2002 | |
| JP | 2007-195694 | | 8/2007 | |
| WO | WO-2005035859 | A1 * | 4/2005 | D06F 67/04 |
| WO | WO-2007134601 | A1 * | 11/2007 | D06F 67/04 |
| WO | WO2019130316 | | 7/2019 | |

OTHER PUBLICATIONS

Extended European Search Report in European Appln. No. 20922592.9, mailed on Feb. 29, 2024, 9 pages.

* cited by examiner

CLOTHES FOLDING DEVICE

CROSS-REFERENCE TO RELATED APPLICATIONS

This application is a National Stage application under 35 U.S.C. § 371 of International Application No. PCT/KR2020/019023, filed on Dec. 23, 2020, which claims the benefit of Korean Application Nos. 10-2020-0027438, filed on Mar. 4, 2020, and 10-2020-0027440, filed on Mar. 4, 2020. The disclosures of the prior applications are incorporated by reference in their entirety.

TECHNICAL FIELD

The present disclosure relates to an automated device that performs the folding of clothes.

BACKGROUND ART

Clothes are made of soft materials such as natural or synthetic fiber, etc., and folding of clothes must be performed to an appropriate size and shape for the purpose of storage and transport thereof.

Generally, clothes are required to be folded very frequently or in large amounts for storage after being washed or for long-term storage according to seasonal changes. However, direct folding of clothes by manpower causes waste of time and resources. Also, when the shape and size of folded clothes do not match due to unskilled manpower, additional labor must be input in for display or storage.

Accordingly, there is an increasing need for an automated device (hereinafter, referred to as a "clothes folding device") which quickly and uniformly perform the folding of clothes. PCT Publication No. 2018-122841 issued on Jul. 5, 2018 discloses a conventional clothes folding device (title of the invention: DOMESTIC COMPACT ARTICLE FOLDING MACHINE HAVING STACKED CONVEYOR LAYERS AND FOLDING METHOD THEREFOR) (hereinafter, referred to as "prior art document"). The prior art document includes technical characteristics of an automated device which performs folding in the process that clothes are pushed in the upper portion and transported, and then discharges from the lower portion.

However, the device of the prior art has the following problems.

Clothes are inserted into the clamp of the device and pushed inside. Then, the clothes are pulled out from the clamp and placed on the conveyor. In this process, the clothes may be damaged.

In addition, the clothes are inserted into the clamp in a horizontal direction. Here, the clamp that has moved the clothes need to move further in the direction in which it has moved in order to release the clothes again in an appropriate position. Here, it is necessary for the clamp to move enough to ensure that the clothing is released. Accordingly, the entire size of device is increased in order to obtain such a moving distance.

In addition, there is a possibility that the clothes inserted into the clamp are easily pulled out of the clamp by an unintended external force such as gravity.

Meanwhile, clothes are fixed by the clamp of the device and pushed into the inside, and then a folding process is performed. As the types and sizes of clothes are different, a distance between the clamp bodies must be adjusted every time. In the case where the distance between the clamp bodies is fixed, there may be clothes that cannot be fixed, or even if the distance is adjustable, the distance has to be adjusted each time.

Also, even though the distance between the clamp bodies can be adjusted, there is a concern that the folding process may not be performed properly because a user cannot find an appropriate position.

Also, when two clamps are used to fix clothes, pressure may be concentrated on the fixing point and damage to the clothes may occur.

DISCLOSURE

Technical Problem

The purpose of the present disclosure is to solve problems such as damage to clothes during a process of loading the clothes, an increase in the volume of the clothes folding device, and clothes being unintentionally pulled out of the clamp, etc., in the clothes folding device.

The purpose of the present disclosure is to solve problems such as damage to clothes during a process of loading the clothes, inconvenience of putting clothes in, and malfunctions in the clothes folding device.

Technical Solution

One embodiment is a clothes folding device including: a loading assembly which causes the clothes to be pushed-in and seats the clothes on a first folding layer equipped with a conveyor for transport; a folding assembly which performs the folding of the clothes while the pushed-in clothes are transported; and an unloading assembly which is disposed below the folding assembly and loads the clothes discharged by the folding assembly. The loading assembly includes: a seating plate which forms an inclined surface at an inlet and allows the clothes to be seated thereon; a clamp assembly which fixes the clothes and moves the clothes to the first folding layer; and a transport roller which presses the clothes seated on the first folding layer and rotates together with the moving of the clothes while pressing the clothes, and thus, preventing the clothes from being separated. The clamp assembly includes a wheel assembly and a clamp plate which presses inserted clothes from both sides. The wheel assembly includes a unidirectional rotating wheel which rotates together with the inserted clothes.

The clamp assembly further comprises a gap maintaining portion which reduces elastically a gap between the clamp plate and the wheel assembly.

The clamp assembly further includes: a wheel cap on which the wheel assembly is mounted rotatably; a wheel case on which the wheel cap is mounted rotatably; a first rotation fastener which fastens the wheel cap and the wheel case, with a first point of the wheel cap eccentric from a rotational axis of the wheel assembly as a rotational axis; a first restoration fastener which is provided at a second point of the wheel cap eccentric from the rotational axis of the wheel assembly; and a second restoration fastener which is provided at a third point of the wheel case. The gap maintaining portion is formed of a spring and connects the first restoration fastener and the second restoration fastener.

The clamp assembly further comprises a release lever which is formed on the wheel cap and is exposed to the outside of the wheel case.

The loading assembly further includes a rail frame which provides a counterpart for inward movement of the clamp assembly. The clamp assembly further includes: a retreat member which moves inward a first distance together with the wheel case while being connected to the wheel case, and then is spaced apart from the wheel case, and further moves inward a second distance; and an elastic member which elastically connects the wheel case and the retreat member and provides a tensile force between the wheel case and the retreat member when the retreat member moves the second distance.

The loading assembly further includes a catching portion which is provided on the rail frame and limits an additional movement of the wheel case when the wheel case moves inward the first distance.

The clamp plate is provided on the retreat member, forms an inclined surface forming upward inclination in a retreat direction, and exposes at least a portion of the wheel in accordance with the second distance moving of the retreat member.

The loading assembly further includes a roller link which mounts the transport roller and is rotatable with respect to the rail frame in accordance with the inward movement of the of clamp assembly.

The loading assembly further includes a roller spring which connects the roller link and a point eccentric with respect to a rotational axis of the transport roller.

The loading assembly further includes: a guide groove formed in the retreat member; and a guide protrusion which is provided on the roller link, moves along the guide groove, and rotates the roller link.

The guide groove includes: a first guide groove which guides a first rotation angle of the roller link; and a second guide groove which guides a second rotation angle of the roller link. The second rotation angle corresponds to an angle at which the clothes seated on the conveyor are pressed by the transport roller.

A distance from a center of rotation of the roller link to the first guide groove is greater than a distance from the center of rotation of the roller link to the second guide groove, and an incline groove is formed between adjacent ends of the first guide groove and the second guide groove.

The loading assembly further includes a driving motor which is installed in the rail frame and generates a driving force for the inward movement of the clamp assembly.

The clothes folding device further includes a primary vertical folding guide which is provided on both lower portions of the seating plate separately and performs primary vertical folding when the seated clothes are pushed in.

The inclined surface is inclined at an angle of 15° to 25° with respect to a horizontal plane.

The wheel assembly includes: a wheel which forms a friction surface; and a unidirectional bearing which is provided within the wheel.

The wheel assembly is provided in the form of a pair in a direction perpendicular to the moving direction of the clothes and fixes two points of the clothes.

Another embodiment is a clothes folding device including: a loading assembly which causes the clothes to be pushed-in and seats the clothes on a first folding layer equipped with a conveyor for transport; a folding assembly which performs the folding of the clothes while the pushed-in clothes are transported; and an unloading assembly which is disposed below the folding assembly and loads the clothes discharged by the folding assembly. The loading assembly includes: a seating plate which forms an inclined surface at an inlet and allows the clothes to be seated thereon; a clamp assembly which fixes the clothes and moves the clothes to the first folding layer; and a transport roller which presses the clothes seated on the first folding layer and rotates together with the moving of the clothes while pressing the clothes, and thus, preventing the clothes from being separated. The clamp assembly includes a clamp plate which forms a rotational axis and is provided to be openable and closeable, and a pressing member, and presses and fixes the clothes in a closed state. The pressing member is provided in the form of teeth.

The pressing member comprises a pressing portion which presses the clothes along a periphery of a neck hole of the clothes in the form of a band.

The pressing portion has a left and right symmetrical shape in which an inner left-right width is greater than an outer left-right width.

The pressing portion is formed along an outer border of the pressing member and forms an opening formed therein, and wherein the opening corresponds to a collar area of the clothes.

The pressing portion includes a plurality of protrusions arranged to be spaced apart from each other to form repetitive separation areas.

The pressing member is formed of an elastic material.

The pressing member and the clamp plate are rotated in engagement in a structure of the spur gear.

The loading assembly further includes: a loading guide which moves the clamp assembly inward; and a rail frame which provides a counterpart for inward movement of the loading guide and forms a rail that guides the inward movement.

The loading assembly further includes a roller link which mounts the transport roller and is rotatable with respect to the rail frame in accordance with the inward movement of the of clamp assembly.

The loading assembly further includes a roller spring which connects the roller link and a point eccentric with respect to a rotational axis of the transport roller.

The loading assembly further includes: a guide groove formed in the loading guide; and a guide protrusion which is provided on the roller link, moves along the guide groove, and rotates the roller link.

The guide groove includes: a first guide groove which guides a first rotation angle of the roller link; and a second guide groove which guides a second rotation angle of the roller link. The second rotation angle corresponds to an angle at which the clothes seated on the conveyor are pressed by the transport roller.

A distance from a center of rotation of the roller link to the first guide groove is greater than a distance from the center of rotation of the roller link to the second guide groove, and an incline groove is formed between adjacent ends of the first guide groove and the second guide groove.

The clothes folding device further includes a primary vertical folding guide which is provided on both lower portions of the seating plate separately and performs primary vertical folding when the seated clothes are pushed in.

The inclined surface is inclined at an angle of 15° to 25° with respect to a horizontal plane.

Advantageous Effects

According to at least one of the embodiments of the present disclosure, it is possible to prevent problems such as clothes being unintentionally pulled out of the clamp to the outside the device, etc.

According to at least one of the embodiments of the present disclosure, it is possible to reduce the possibility that the clothes are damaged by the clamp.

According to at least one of the embodiments of the present disclosure, it is possible to minimize the wrinkle occurring in the process of vertical folding of the clothes.

According to at least one of the embodiments of the present disclosure, it is possible to reduce the size of the device because the distance that the clamp has to move in order to release the clothes becomes smaller.

According to at least one of the embodiments of the present disclosure, the clothes seated on the conveyor may not be separated to the outside of the device by that the clothes hang down.

According to at least one of the embodiments of the present disclosure, it is possible to fix the clothes seated on the conveyor without an additional power source.

According to at least one of the embodiments of the present disclosure, it is possible to fix clothes having various types and sizes without moving the clamp. Also, according to at least one of the embodiments of the present disclosure, it is possible to reduce the possibility that the clothes are damaged by that pressure is concentrated on the clothes when the clothes are fixed.

According to at least one of the embodiments of the present disclosure, the pressing area of the clothes may be variably changed in response to the size of the clothes.

According to at least one of the embodiments of the present disclosure, it is possible to minimize the wrinkle occurring in the process of vertical folding of the clothes.

According to at least one of the embodiments of the present disclosure, the clothes seated on the conveyor may not be separated to the outside of the device by that the clothes hang down.

According to at least one of the embodiments of the present disclosure, it is possible to fix the clothes seated on the conveyor without an additional power source.

Further scope of applicability of the present invention will become apparent from the following detailed description for embodying the present invention. However, since various changes and modifications within the spirit and scope of the present invention can be clearly understood by those skilled in the art, specific embodiments such as embodiments included in the following detailed description for embodying the present invention should be understood as being merely illustrative.

MODE FOR INVENTION

Figure 1:
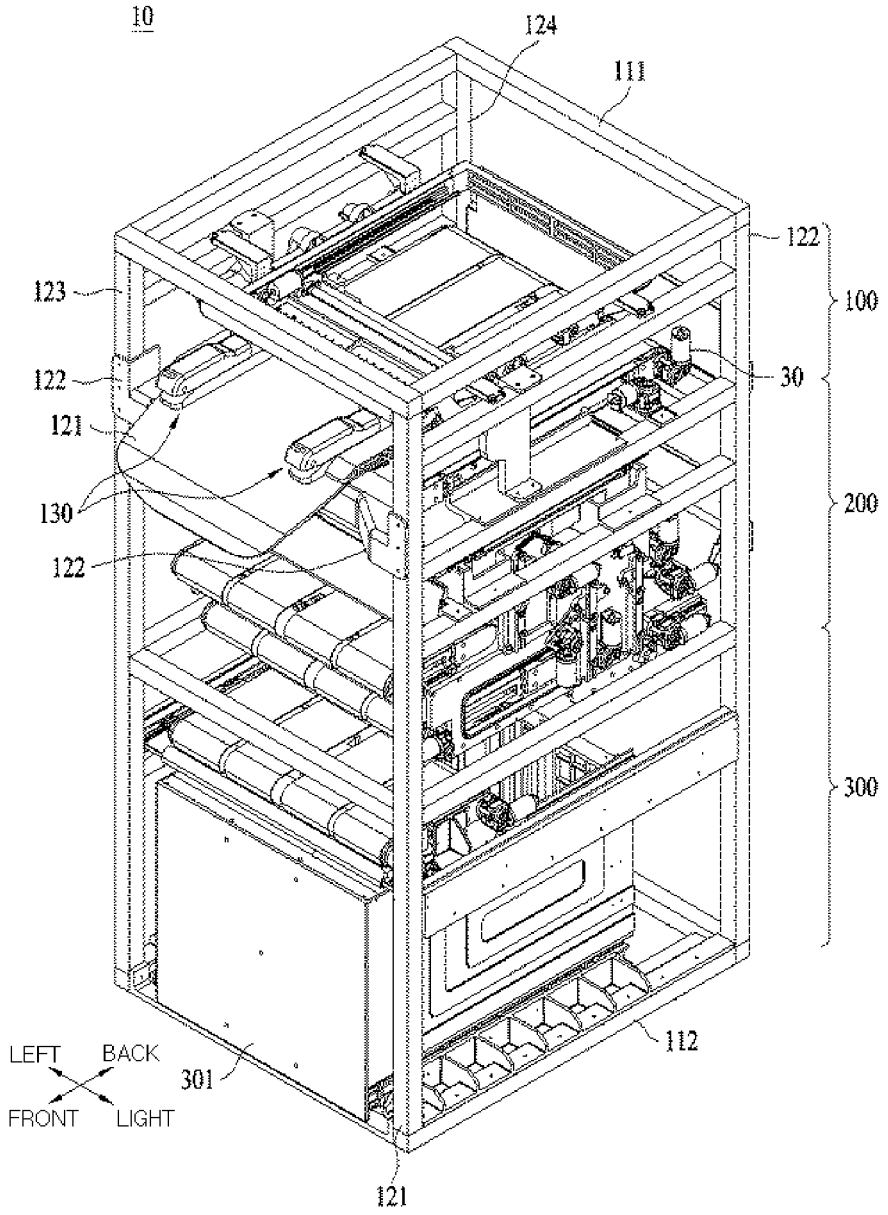
FIG. 1 is a perspective view of a clothes folding device according to a first embodiment of the present disclosure.

Hereinafter, embodiments disclosed in this specification will be described in detail with reference to the accompanying drawings. The same or similar elements will be denoted by the same reference numerals irrespective of drawing numbers, and repetitive descriptions thereof will be omitted. A suffix "assembly" and "part" for the component, which is used in the following description, is given or mixed in consideration of only convenience for ease of specification, and does not have any distinguishing meaning or function per se. Also, in the following description of the embodiment disclosed in the present specification, the detailed description of known technologies incorporated herein is omitted to avoid making the subject matter of the embodiment disclosed in the present specification unclear. Also, the accompanied drawings are provided only for more easily describing the embodiment disclosed in the present specification. The technical spirit disclosed in the present specification is not limited by the accompanying drawings. All modification, equivalents and substitutes included in the spirit and scope of the present invention are understood to be included in the accompanying drawings.

While terms including ordinal numbers such as the first and the second, etc., can be used to describe various components, the components are not limited by the terms mentioned above. The terms are used only for distinguishing between one component and other components.

In the case where a component is referred to as being "connected" or "accessed" to another component, it should be understood that not only the component is directly connected or accessed to the other component, but also there may exist another component between them. Meanwhile, in the case where a component is referred to as being "directly connected" or "directly accessed" to another component, it should be understood that there is no component therebetween.

An expression of a singular form includes the expression of plural form thereof unless otherwise explicitly mentioned in the context.

In the present specification, it should be understood that the term "include" or "comprise" and the like is intended to specify characteristics, numbers, steps, operations, components, parts or any combination thereof which are mentioned in the specification, and intended not to previously exclude the possibility of existence or addition of at least one another characteristics, numbers, steps, operations, components, parts or any combination thereof.

Figure 2:
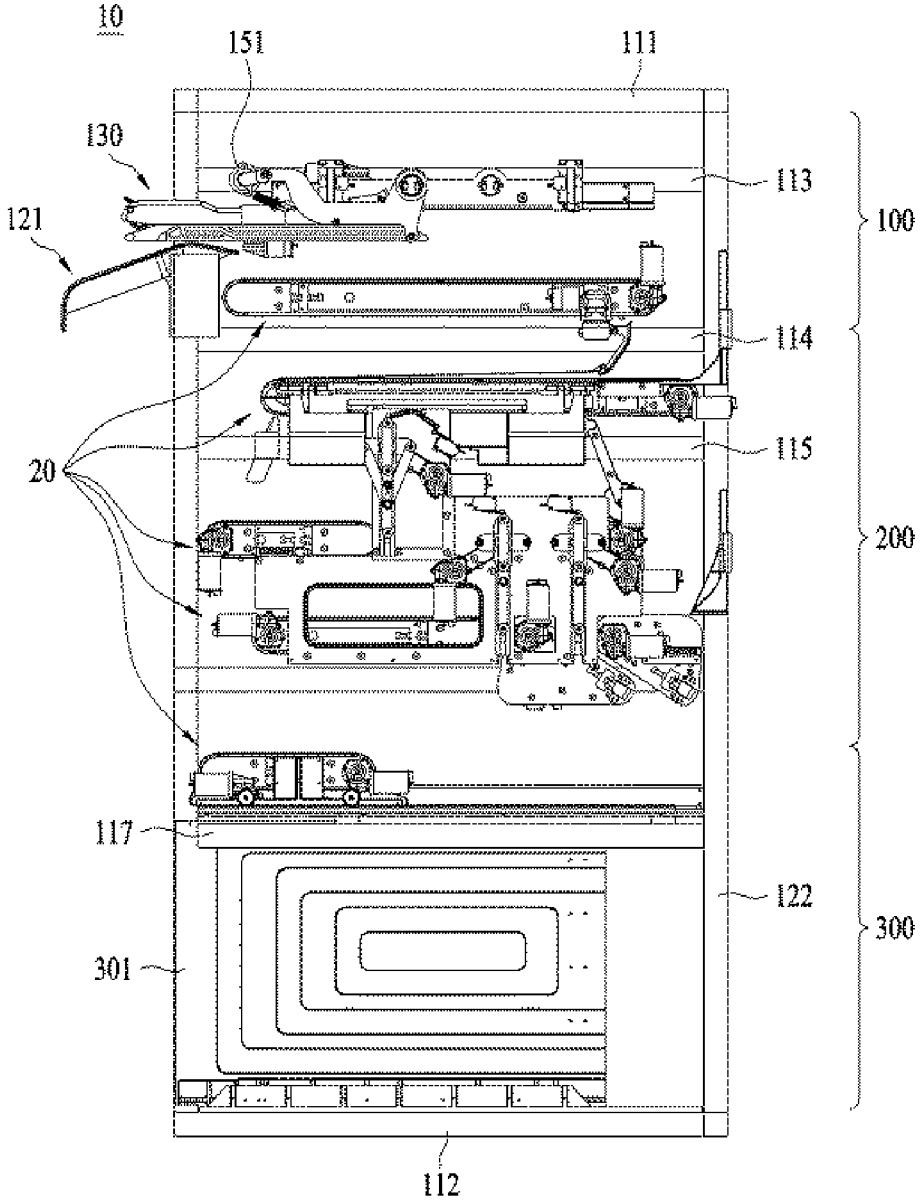
FIG. 2 is a side view of the clothes folding device of FIG. 1.
Figure 3:
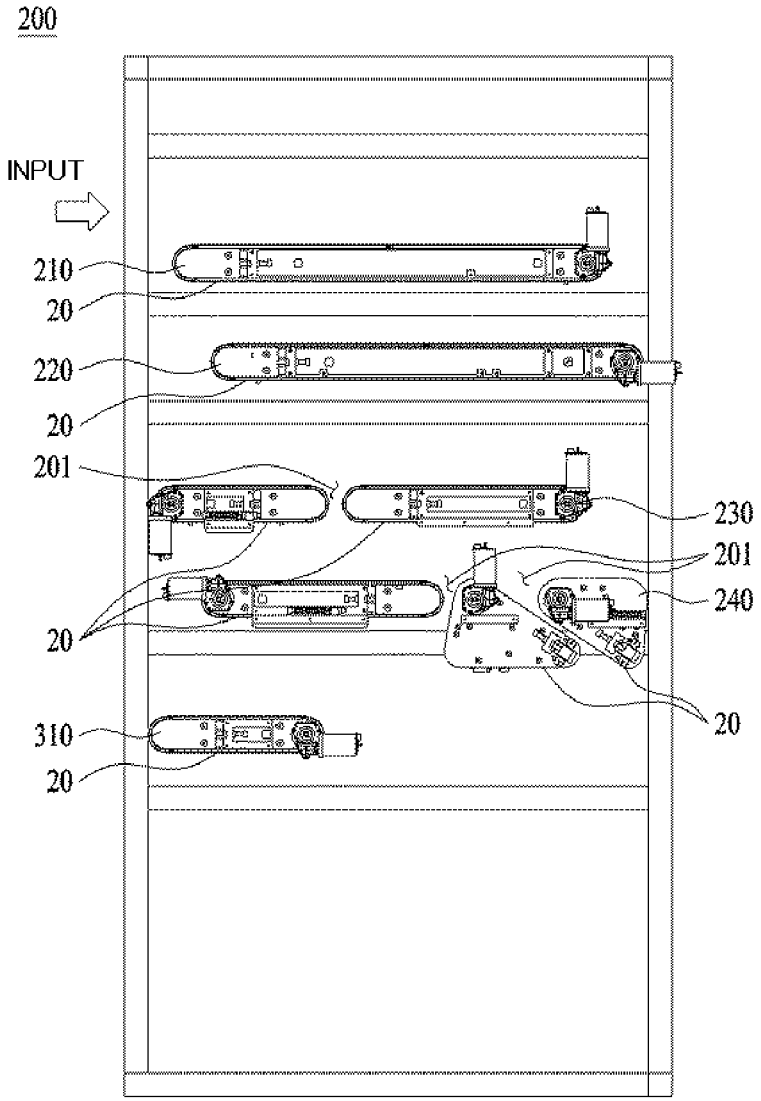
FIG. 3 is a side view of the clothes folding device, which shows a configuration of a folding assembly in the first embodiment of the present disclosure.

Hereinafter, a clothes folding device 10 according to the present invention will be described based on the description with reference to FIGS. 1 to 3. FIG. 1 is a perspective view of the clothes folding device 10 according to a first embodiment of the present disclosure. FIG. 2 is a side view of the clothes folding device 10 of FIG. 1. FIG. 3 is a side view of the clothes folding device 10, which shows a configuration of a folding assembly 200 in the first embodiment of the present disclosure.

Referring to FIGS. 1 to 2, the clothes folding device 10 according to the first embodiment of the present disclosure may be supported and installed in a frame 110. The frame 110 may function as an external skeleton of the clothes folding device 10. The frame 110 is disposed at the outer edge of the clothes folding device 10 and defines a minimum working space of the clothes folding device 10, and can stably attach and support various members constituting the clothes folding device 10.

The frame 110 includes an upper frame 111, a lower frame 112, and horizontal frames 113, 114, 115, 116, and 117. The frame 110 includes vertical frames 121, 122, 123, and 124 disposed vertically to support the upper frame 111, the lower frame 112, and the horizontal frame (see FIG. 1).

A finish cover (not shown) may be stably attached to the outer surface of the frame 110. The finish cover may form an exterior of the clothes folding device 10.

Referring to FIGS. 1 to 2, the clothes folding device 10 includes a loading assembly 100, a folding assembly 200, and an unloading assembly 300.

The loading assembly 100, the folding assembly 200, and the unloading assembly 300 may be supported by the frame 110. In addition, working spaces of the loading assembly 100, the folding assembly 200, and the unloading assembly 300 may be defined by the frame 110.

For example, the working space of the loading assembly 100 may be defined by the upper frame 111 and the horizontal frame 114, and the working space of the unloading assembly 300 may be defined by the horizontal frame 116 and the lower frame 112.

The loading assembly 100 is provided such that clothes are pushed in. The loading assembly 100 may be provided such that the pushed-in clothes can be placed on the upper surface of a conveyor 20. Specifically, the loading assembly 100 may be placed on the upper surface of the conveyor 20 of a first folding layer 210 between the upper frame 111 and the horizontal frame 114.

Here, the term "clothes" refers to a top or bottom made of natural or synthetic fibers that can be worn by humans, and also includes any article that can be provided folded to a desired size and thickness through the clothes folding device, such as a towel or blanket.

A plurality of conveyors 20 may be supported by horizontal frames 113, 114, 115, 116, and 117.

The unloading assembly 300 loads the clothes discharged by the folding assembly 200. The unloading assembly 300 may be provided such that the folded clothes are discharged from the folding assembly 200 and primarily transported to an unloading layer 310, and are loaded in a discharge portion 301 from the unloading layer 310. The folding assembly 200 is provided such that the pushed clothes are folded while being transported. The folding assembly 200 includes at least two folding layers such that the pushed-in clothes are folded to a certain size and shape while being transported. The at least two folding layers are placed above and below and are spaced apart from each other. As the pushed-in clothes are transported from the upper folding layer to the lower folding layer, folding occurs at least once in each folding layer, and as a result, the clothes which have been folded to a certain size and shape are collected by the unloading assembly 300.

As in the embodiment of FIG. 3, the folding assembly 200 may include four folding layers 210, 220, 230, and 240. The four folding layers 210, 220, 230, and 240 may be placed above and below and are spaced apart from each other. As the pushed-in clothes are transported from the first upper folding layer 210 to the fourth lower folding layer 240, the four folding layers function to cause the pushed-in clothes to be folded to a certain size and shape. The folding occurs at least once in each folding layer. In particular, the folding may occur twice in the fourth folding layer 240.

The folding layers 210, 220, 230, and 240 are responsible for seating, transporting, and folding clothes. Each of the folding layers 210, 220, 230, and 240 is provided with at least one conveyor 20 to perform the functions described above, in particular transporting and folding. In particular, the clothes are folded by being inserted into two adjacent conveyors 20 on one folding layer. This is implemented such that the clothes can be folded or can pass while being folded, by a folding gap 201 between two adjacent conveyors 20 on one folding layer.

As in the embodiment of FIG. 3, the four folding layers 210, 220, 230, and 240 may include at least one conveyor 20. The third folding layer 230 may include two conveyors 20, and the fourth folding layer 240 may include three conveyors 20. The folding gap 201 may be formed between the two conveyors provided in the third folding layer 230 in order to allow the clothes to pass through while being folded. Two folding gaps 201 may be formed between the three conveyors provided in the fourth folding layer 240 in order to allow the clothes to be folded or to pass through while being folded.

When the clothes completely pass through the folding gap 201, folding and discharging to the lower layer are simultaneously performed. When the clothes are inserted into the folding gap 201 and pulled out again, only folding can be performed.

As in the embodiment of FIG. 3, the clothes are vertically folded in one folding layer 220 of the four folding layers constituting the folding assembly 200 (more precisely, the folding layer 220 is limited to the secondary vertical folding, and the primary vertical folding is performed by the loading assembly 100), and the clothes may be horizontally folded in the lower two folding layers 230 and 240.

Here, the horizontal folding means that the clothes are folded with respect to a reference line perpendicular to a proceeding direction of the clothes. The direction perpendicular to the proceeding direction of the clothes is not limited to an exact angle of 90 degrees between the proceeding direction of the clothes and a folding line of the clothes, and includes an error range of 0 to 30 degrees.

Here, the vertical folding means that the clothes are folded with respect to a reference line parallel to the proceeding direction of the clothes. The direction parallel to the proceeding direction of the clothes is not limited to an exact angle of 0 degree between the proceeding direction of the clothes and a folding line of the clothes, and includes an error range of 0 to 30 degrees.

Hereinafter, the structure and function of the loading assembly 100 will be described in detail.

FIGS. 4 to 10 show sequential operations of the loading assembly 100 according to the first embodiment of the present disclosure.

The loading assembly 100 serves to seat the clothes input to the clothes folding device 10 on the first folding layer 210 equipped with an initial conveyor 20. The seating process of the clothes will be briefly described as follows based on the clothes.

Figure 4:
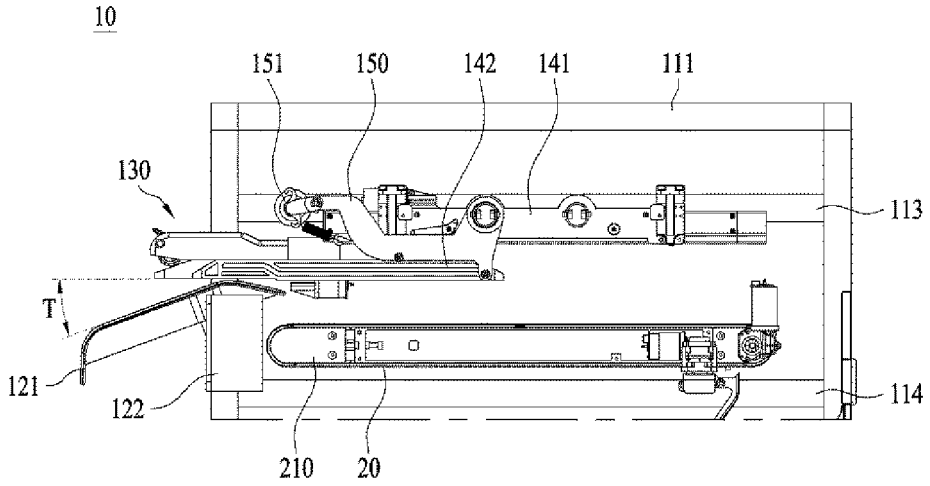
FIGS. 4 to 10 show sequential operations of a loading assembly according to the first embodiment of the present disclosure.
Figure 5:
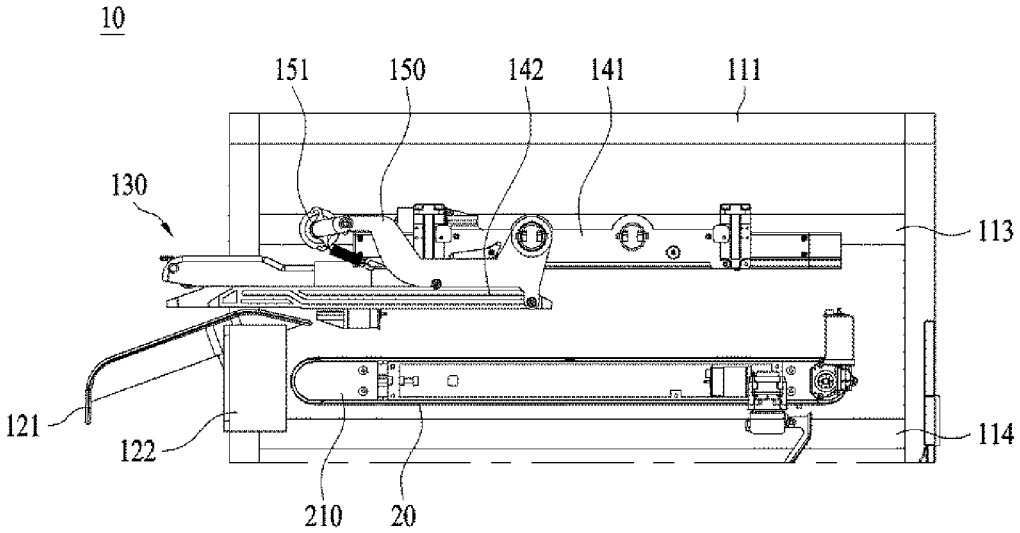
Figure 6:
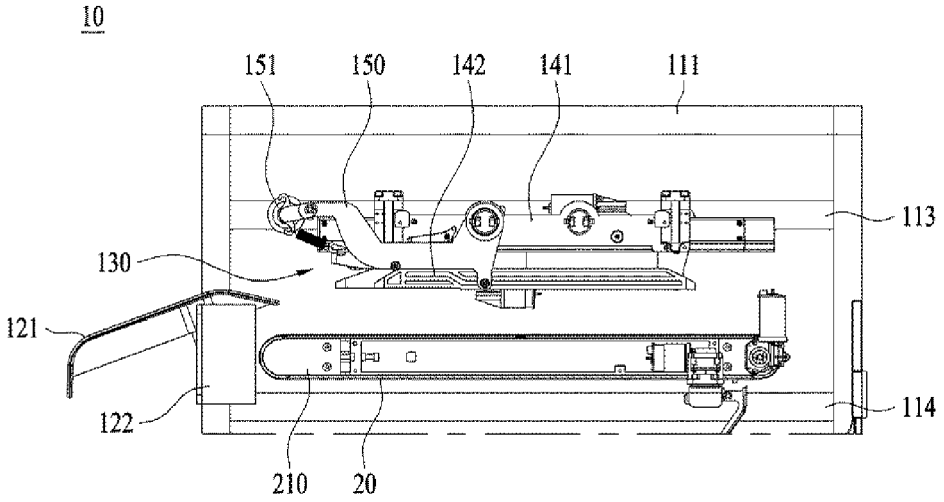
Figure 7:
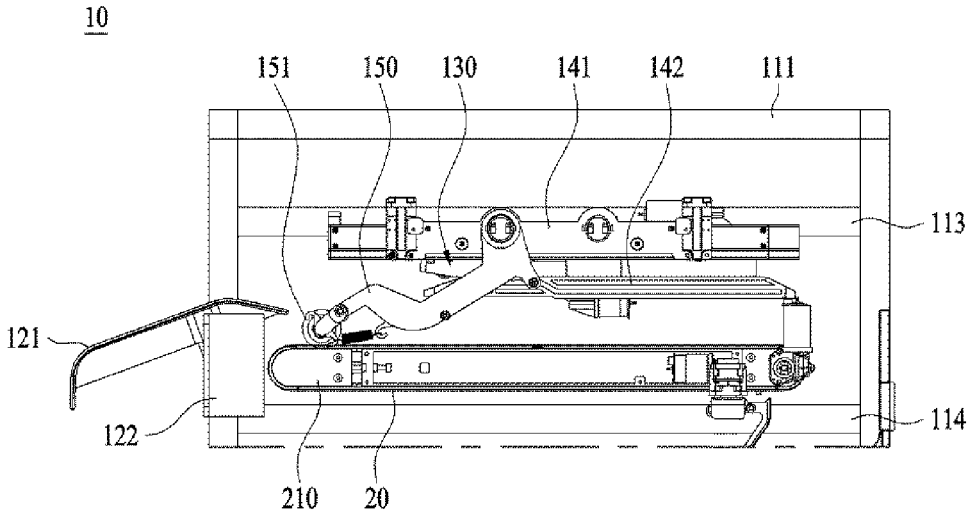
Figure 8:
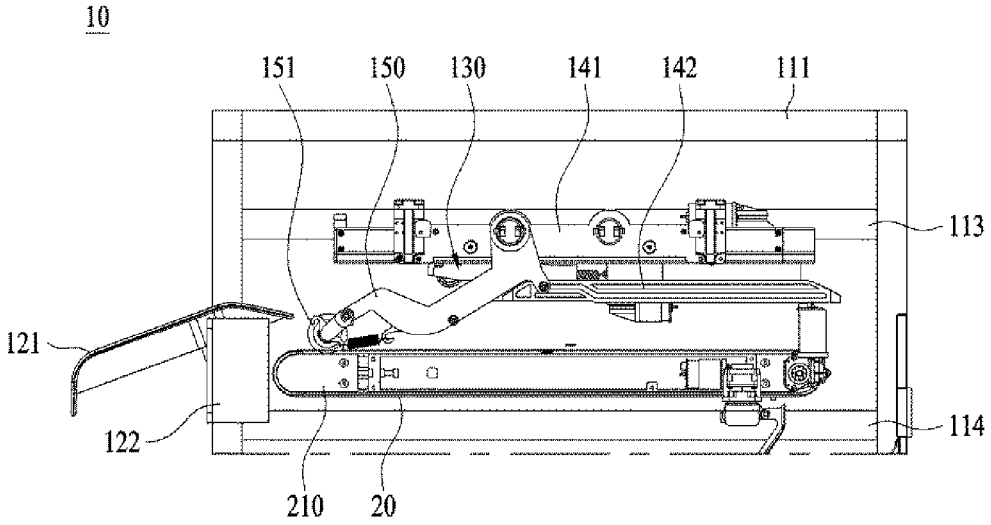
Figure 9:
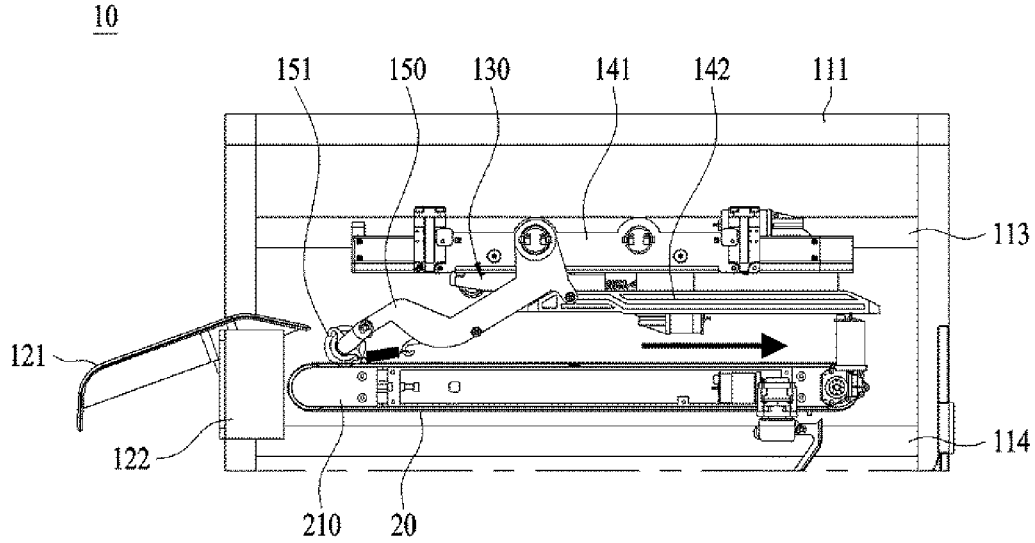
Figure 10:
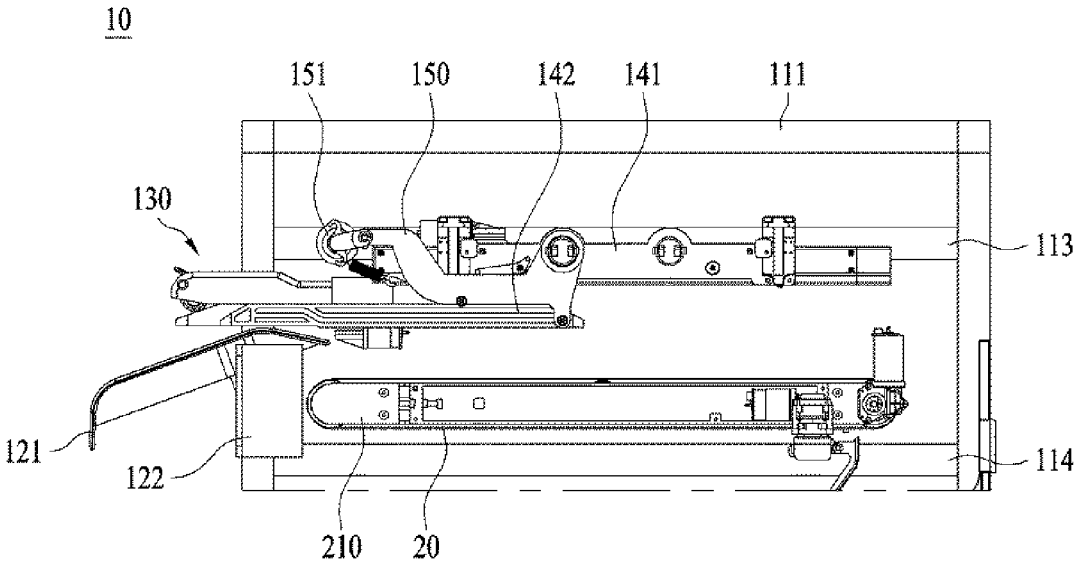

A first step before the clothes are fixed to a clamp assembly 130 (see FIG. 4);

A second step in which the clothes are fixed to the clamp assembly 130 in a state where the clothes are seated on a seating plate 121 (see FIG. 5);

A third step in which the clothes are moved by the clamp assembly 130 while being fixed to the clamp assembly 130 and are vertically primarily folded in the moving process (see FIG. 6);

A fourth step in which the clothes are seated on the first folding layer 210 (see FIG. 6);

A fifth step in which the clothes are fixed to the first folding layer 210 by a transport roller 151 (see FIG. 7);

A sixth step in which the fixing of the clamp assembly 130 is released (see FIG. 8);

A seventh step in which the clothes are moved a certain distance by the first folding layer 210 (see FIG. 9);

An eighth step in which the fixing of the transport roller 151 is released (see FIG. 10).

The above-described order may be applied differently if necessary. In particular, adjacent steps may be performed simultaneously.

Hereinafter, characteristics applied to the above-described steps will be described in more detail.

Figure 11:
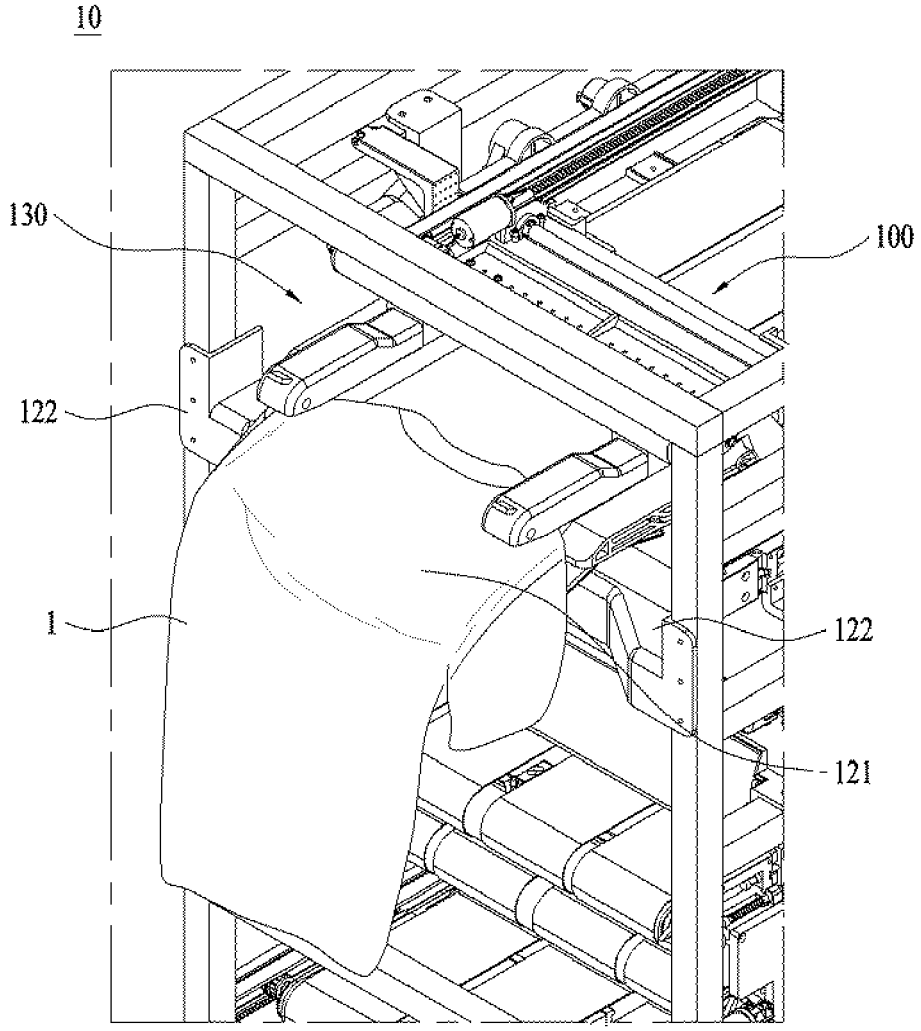
FIG. 11 shows that the clothes folding device according to the first embodiment of the present disclosure in a state where clothes are mounted on a seating plate in order that the clothes are input.

FIG. 11 shows that the clothes folding device 10 according to the first embodiment of the present disclosure in a state where clothes 1 are mounted on the seating plate 121 in order that the clothes 1 are input.

The seating plate 121 serves to cause the clothes 1 to be preliminarily mounted before the clothes 1 are input to the clothes folding device 10. The seating plate 121 has its width less than left and right widths of the clothes 1, particularly an upper portion of the clothes, so that the remaining portion of the clothes 1 hangs down by gravity.

A primary vertical folding guide 122 is provided symmetrically on both lower left and right sides of the seating plate 121. A portion of the left and right areas of the clothes 1, particularly, of the area not in contact with the seating plate 121 comes into contact with the primary vertical folding guide 122. Then, as the clothes 1 moves into the device, the clothes are folded behind the area in contact with the seating plate 121, so that the primary vertical folding is performed.

Here, the seating plate 121 may form a surface which is inclined downward at an inlet side of the loading assembly by an angle of T (see FIG. 4). Considering that clothes, especially a top, is shaped and sewn based on a three-dimensional state where a wearer wears the top, it can be expected that the seating plate 121 with the inclined surface at the inlet side is less wrinkled than the seating plate 121 with a horizontal plane shape. Even actual experimental results show that the least amount of wrinkles occur in the top of the clothes inclined by an angle of 15° to 25° with respect to a horizontal plane is least wrinkled.

Figure 12A:
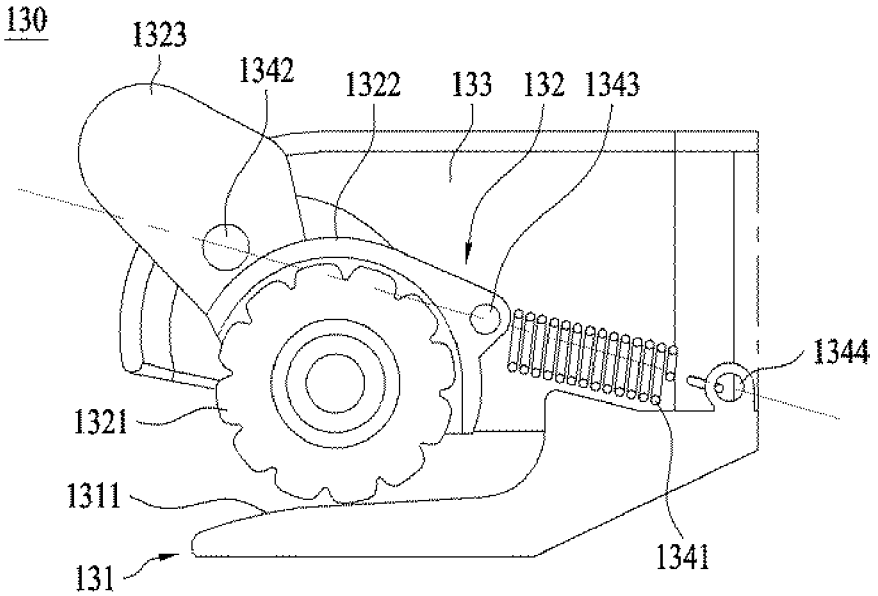
FIG. 12 is a cross-sectional view with respect to a rotational axis of a wheel, which shows respectively states before and after clothes are inserted into a clamp assembly, in accordance with the first embodiment of the present invention.
Figure 12B:
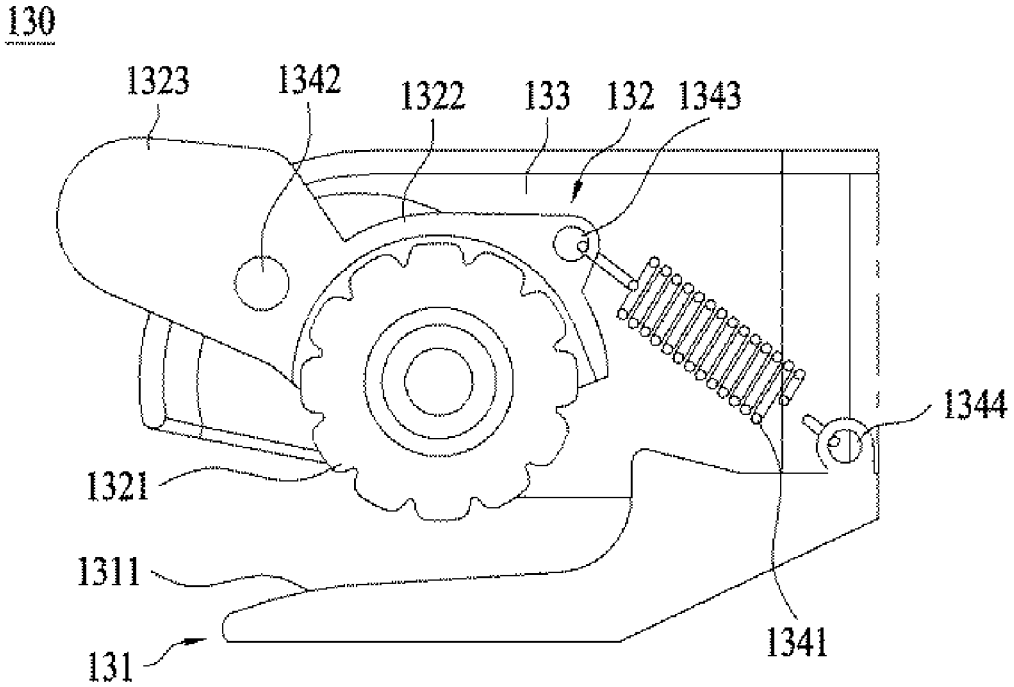
Figure 13:
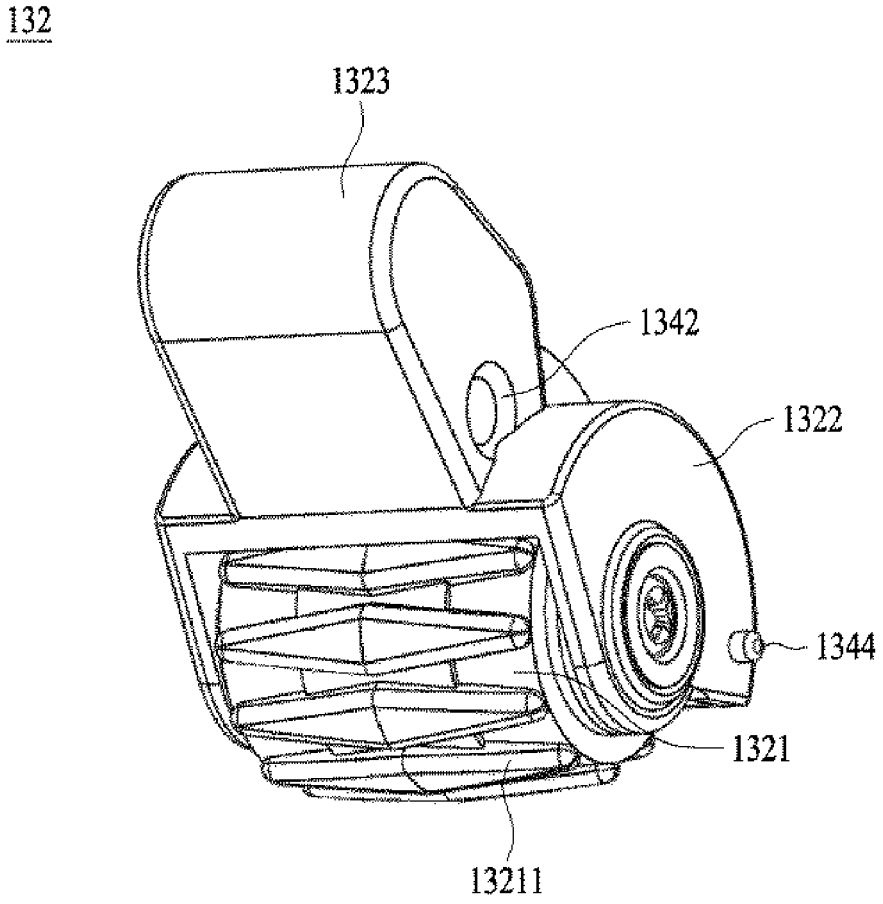
FIG. 13 is a rear perspective view of the clamp assembly according to the first embodiment of the present disclosure.
Figure 14A:
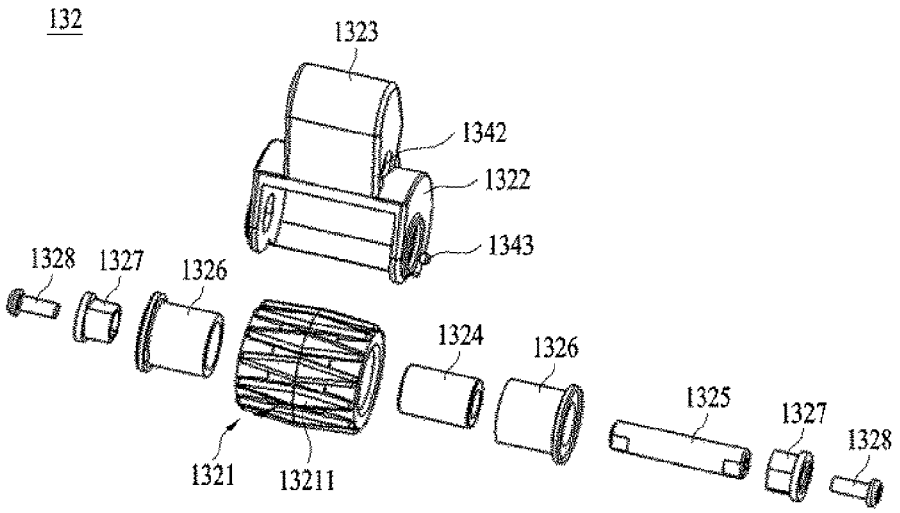
FIG. 14 is a longitudinal sectional view based on the exploded perspective view of FIG. 11 and the rotational axis of the wheel.
Figure 14B:
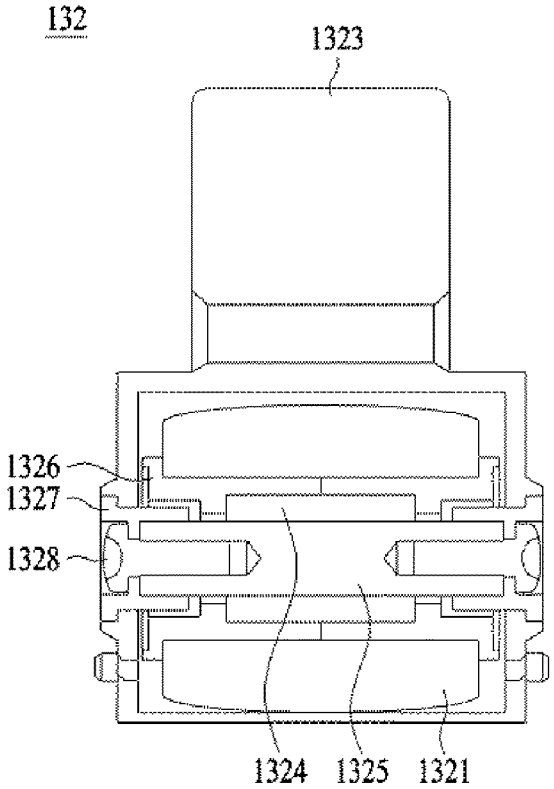

FIG. 12 is a cross-sectional view with respect to a rotational axis of a wheel 1321, which shows respectively states before and after clothes are inserted into the clamp assembly 130, in accordance with the first embodiment of the present invention. FIG. 13 is a rear perspective view of the clamp assembly 130 according to the first embodiment of the present disclosure. FIG. 14 is a longitudinal sectional view based on the exploded perspective view of FIG. 11 and the rotational axis of the wheel 1321.

The clamp assembly 130 fixes the inserted clothes and moves the clothes inward. The clamp assembly 130 includes a clamp plate 131 and a wheel assembly 132. The clamp plate 131 presses the inserted clothes from both sides.

The wheel assembly 132 maintains an adjacent gap to the clamp plate 131 by the gap maintaining portion 1341 (preferably comes into contact), and when the clothes are inserted, the gap is increased by the thickness of the clothes. The gapped clamp assembly 130 continuously presses both sides of the clothes by a tensile force of the gap maintaining portion 1341. This pressure prevents the clothes from being unintentionally pulled out of the clamp assembly 130.

The gap between the wheel assembly 132 and the clamp plate 131 is changed by the rotation of a wheel cap 1322 on which the wheel assembly 132 is mounted. The wheel cap 1322 is mounted on a wheel case 133, and is rotatably fastened to the wheel case 133 through a first rotation fastener 1342. The first rotation fastener 1342 is formed at a first point of the wheel cap 1322 eccentric from the rotational axis of the wheel assembly 132.

A first restoration fastener 1343 and a second restoration fastener 1344 are provided at a second point of the wheel cap 1322 and a third point of the wheel case 133, respectively, such that both ends of the spring-shaped gap maintaining portion 1341 can be fastened. That is, the first restoration fastener 1343 and the second restoration fastener 1344 serve as an action point of a tensile force for reducing a gap between the wheel cap 1322 and the wheel case 133.

The tensile force between the first restoration fastener 1343 and the second restoration fastener 1344 is converted to a torque at the first rotation fastener 1342, so that the gap between the wheel case 133 and the wheel cap 1322 (and the wheel assembly 132) is reduced, and thus, the clothes can be fixed.

Meanwhile, when the clothes fixed to the clamp assembly 130 are forcibly removed again, the inserted clothes can be removed by pulling the clothes. However, this may cause damage to the clothes. In order to overcome this, the wheel cap 1322 is provided with a release lever 1323. The release lever 1323 may be formed to extend from the wheel cap 1322, and in particular, may be exposed to the outside of the wheel case 133. When the release lever 1323 exposed to the outside of the wheel case 133 is pressed, a torque in the opposite direction to the force generated by the gap maintaining portion 1341 is generated, so that the gap between the wheel assembly 132 and the clamp plate 131 is increased. Accordingly, if the clothes are removed while the release lever 1323 is pressed, the clothes can be removed without damage.

The wheel assembly 132 includes a unidirectional rotating wheel 1321 that is rotatable only in one direction. The rotation direction of the wheel 1321 corresponds to the insertion direction of the clothes. More specifically, the wheel 1321 is provided such that a region of the wheel assembly 132 that is in contact with the inserted clothes moves together with the inserted clothes. Accordingly, the wheel 1321 rotates smoothly when the clothes are inserted, and conversely, when the clothes are pulled out, the wheel 1321 does not rotate, so that the clothes are not easily pulled out due to friction between the clothes and the wheel 1321.

The wheel assembly 132 may include the wheel 1321 forming a friction surface and may include a unidirectional bearing 1324 provided within the wheel. The unidirectional bearing 1324 is coupled to the wheel and rotates unidirectionally the wheel 1321.

Since the clamp plate 131 is provided on the lower surface of the wheel assembly 132, the wheel cap 1322 covers the upper portion of the wheel assembly 132 and opens the lower portion of the wheel assembly 132.

In consideration of the operation scene of the release lever 1323, it is desirable that the first point should be formed in the front region of the wheel cap 1322.

It is preferable that the second point of the wheel cap 1322 to which the gap maintaining portion 1341 is fastened and the third point of the wheel case 133 should be positioned on a straight line with the first point while the wheel assembly 132 maintains an adjacent gap to the clamp plate 131 (preferably comes into contact). As a result, the wheel assembly 132 in a state where the clothes folding device 10 is not in operation is prevented from unnecessarily pressing the clamp plate 131 or the gap is prevented from being excessively increased.

The wheel 1321 has a high coefficient of friction by forming irregularities 13211 on the outer circumferential surface thereof. The high coefficient of friction increases a frictional force when the wheel 1321 fixes clothes. In the wheel assembly 132, the unidirectional bearing 1324 is coupled to the outer circumferential surface of a shaft 1325 serving as a central axis of rotation, and an inner hinge 1326 is fastened by a screw 1328 to the inside of the outer circumferential surface 1325 to which the unidirectional bearing 1324 is coupled, and an outer hinge 1327 is fastened to the outside of the shaft 1325 by the screw 1328. The inner hinge 1326 and the outer hinge 1327 provide a counterpart to which the wheel cap 1322 is fastened. The wheel and inner hinge 1326 rotate unidirectionally relative to the shaft 1325 via the unidirectional bearing 1324.

Figure 15A:
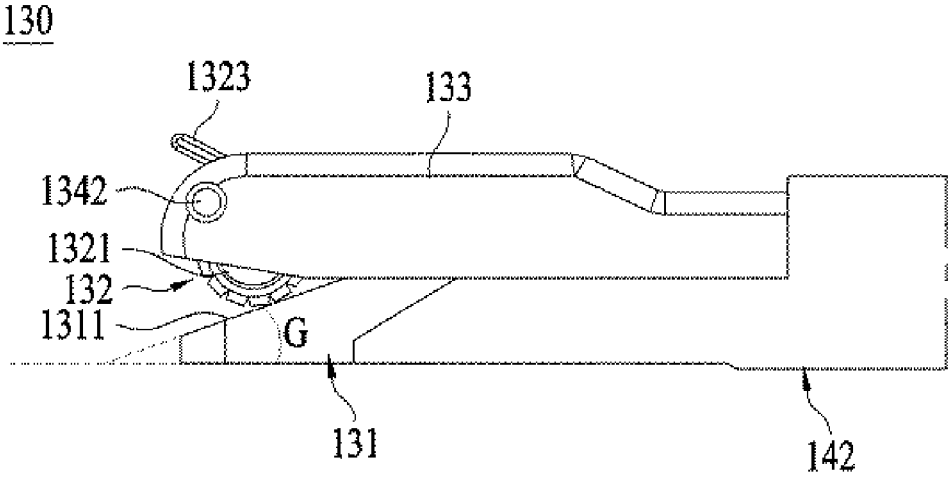
FIG. 15 is a side view of the clamp assembly before and after the clothes are fixed according to the first embodiment of the present disclosure.
Figure 15B:
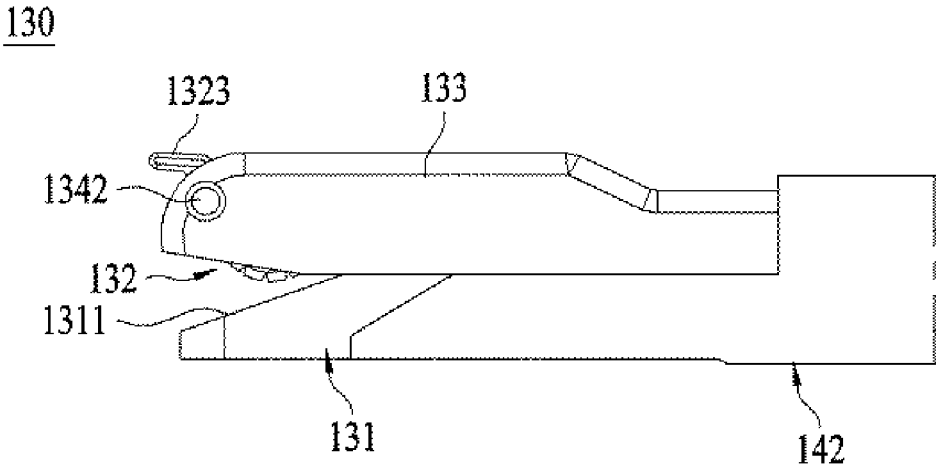

FIG. 15 is a side view of the clamp assembly 130 before and after the clothes are fixed according to the first embodiment of the present disclosure.

The state of FIG. 15 (*a*) corresponds to the state of FIG. 12 (*a*), and the state of FIG. 15 (*b*) corresponds to the state of FIG. 12 (*b*).

The clamp plate 131 is provided under the wheel assembly 132. The clamp plate 131 may include a seating surface 1311 that forms a forward downward inclination. That is, the seating surface 1311 forms a backward upward inclination. This is to minimize wrinkling of the clothes by avoiding bending of the clothes as much as possible when the clothes are inserted and fixed to the clamp assembly 130. Furthermore, the seating surface 1311 forms an inclination because the clothes inserted into the seating surface 1311 are intended to be naturally pulled out forward and downward and seated on the first folding layer 210. Based on these characteristics, it is preferable that an inclination angle "G" of the seating surface 1311 of the clamp plate 131 should be between 20° and 40° with respect to a horizontal plane.

Figure 16:
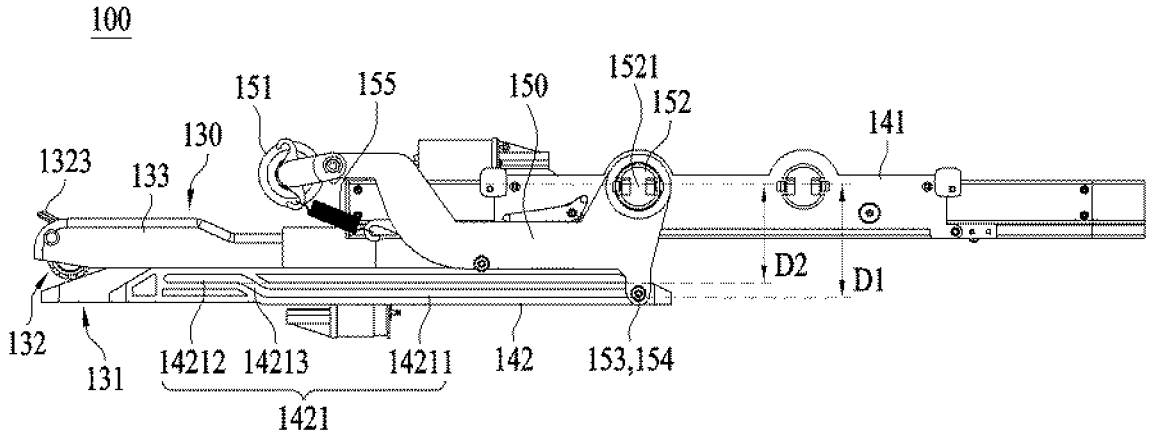
FIGS. 16 and 17 are side views of two states of a portion of the loading assembly, in accordance with the first embodiment of the present disclosure.
Figure 17:
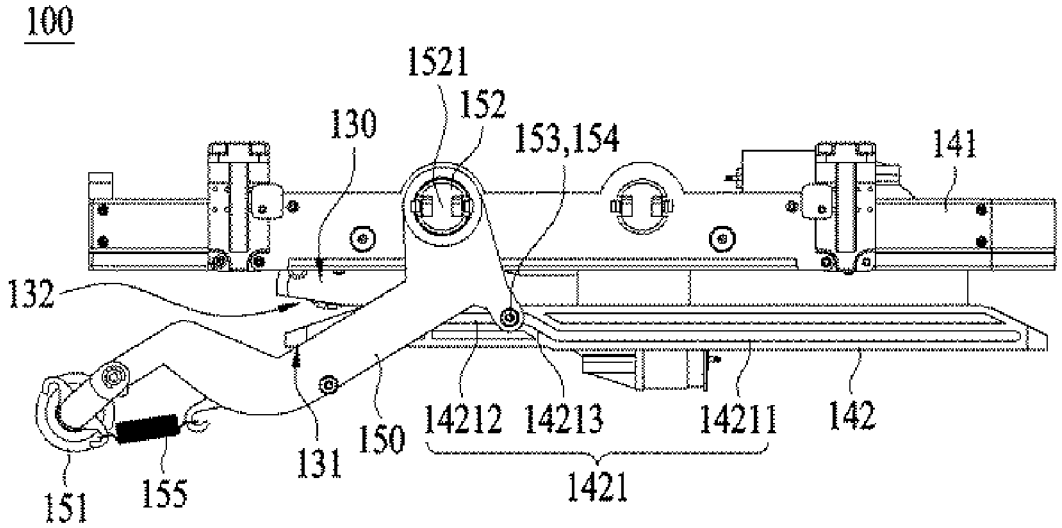

FIGS. 16 and 17 are side views of two states of a portion of the loading assembly 100, in accordance with the first embodiment of the present disclosure.

A retreat member 142 is a component of the loading assembly 100 and moves the clamp assembly 130 inward. The retreat member 142 may be formed to extend to the rear of the clamp assembly 130, in particular, the clamp plate 131. Accordingly, the forward and backward movements of the retreat member 142 and the clamp assembly 130 are dependent on each other. The clothes inserted and fixed to the clamp assembly 130 are moved backward by the retreat member 142 (FIG. 5→FIG. 6→FIG. 7).

The retreat member 142 forms a structure in which the retreat member 142 moves slidingly forward and backward with respect to a rail frame 141 that is a counterpart fixed on the clothes folding device 10.

A roller link 150 is a component of the loading assembly 100 and may be provided to be rotatable with respect to the rail frame 141 according to the forward and backward movement of the clamp assembly 130 and the retreat member 142.

The roller link 150 mounts the transport roller 151. Therefore, when the clamp assembly 130 moves inward and backward, the transport roller 151 rotates to descend, and conversely, when the clamp assembly 130 moves outward and forward, the transport roller 151 rotates to ascend. This dependent structure is effective in that it can be implemented without a separate actuator for moving the transport roller 151.

An example for implementing such a mechanism is provided. The roller link 150 has a second rotation fastener 152 that is rotatably fastened to the rail frame 141 at one point of the roller link, and a slide fastener 153 that is slidably fastened to the retreat member 142 at the other point of the roller link. At least one side of the retreat member 142 is provided with a guide groove 1421, and the roller link 150 is provided with a guide protrusion 154 that can move along the guide groove 1421, so that they can be slide-fastened. The guide protrusion 154 is one form of the slide fastener 153.

The guide groove 1421 may form an area forming two different distances from a rotation fastening point 1521 for the rotation of the roller link 150. When the guide protrusion 154 is positioned in a first guide groove 14211 at a longer distance D1 from the rotation fastening point 1521, the roller link 150 is in a first rotation angle state where the transport roller 151 ascends, when the guide protrusion 154 is positioned in a second guide groove 14212 at a shorter distance D2 from the rotation fastening point 1521, the roller link 150 is in a second rotation angle state where the transport roller 151 descends. In the second rotation angle state, the transfer roller 151 may be positioned at an angle at which the clothes seated on the first folding layer 210 are pressed.

An incline groove 14213 connecting obliquely the two guide grooves 1421 is provided between the first guide groove 14211 and the second guide groove 14212, so that the guide projection 154 does not get caught when moving between the first guide groove 14211 and the second guide groove 14212.

Figure 18:
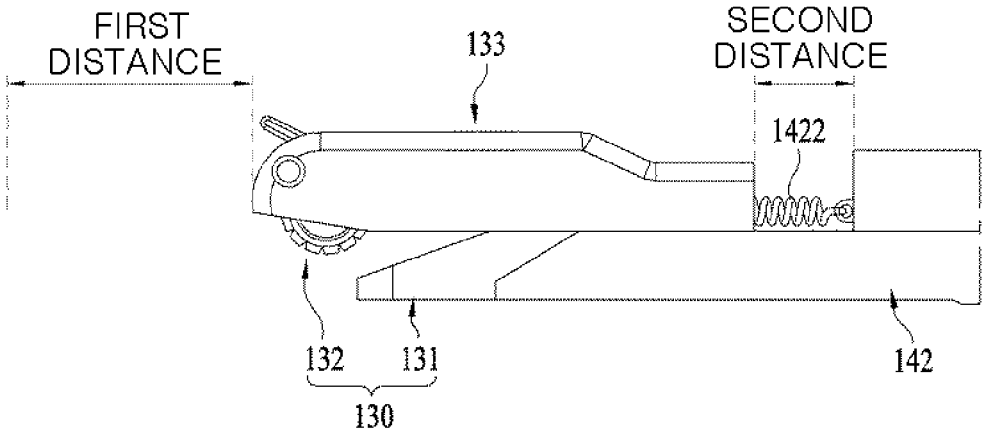
FIGS. 18 and 19 are side views of the clamp assembly and the loading assembly in the same one state, in accordance with the first embodiment of the present disclosure.
Figure 19:
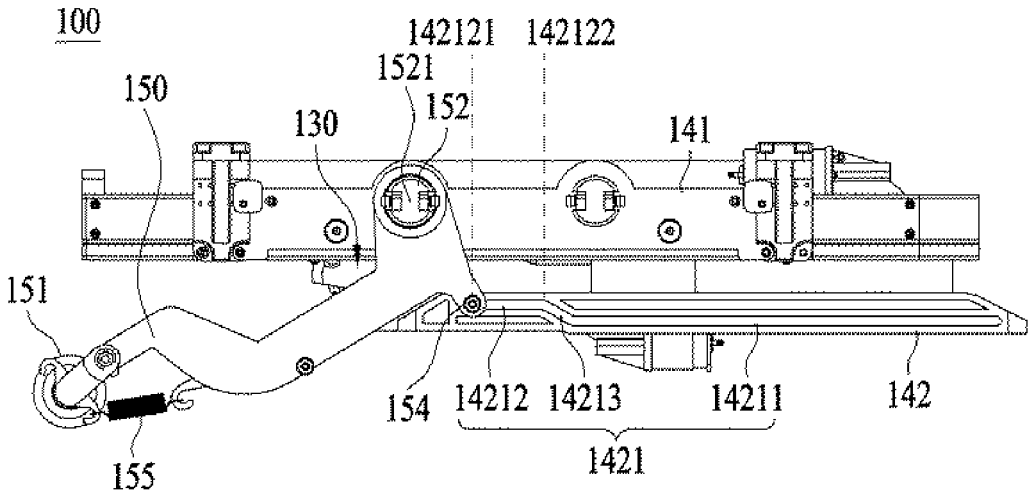

FIGS. 18 and 19 are side views of the clamp assembly 130 and the loading assembly 100 in the same one state, in accordance with the first embodiment of the present disclosure. Reference is made to FIGS. 5 to 8 together.

After the transport roller 151 descends and the clothes are fixed to the first folding layer 210, the clamp assembly 130 places the inserted clothes (This is defined as the clothes release of the clamp assembly 130). The clothes release of the clamp assembly 130 may be implemented by an additional retreating movement of the retreat member 142 from the wheel case 133. Here, the term "retreat" refers to moving from the front to the rear of the clothes folding device 10.

That is, the retreat member 142 moves backward a first distance together with the wheel case 133 after the clothes are fixed (FIG. 5→FIG. 6→FIG. 7). After the clothes are fixed to the transport roller 151, the wheel case 133 is in place and the retreat member 142 further retreats backward by a second distance (FIG. 7→FIG. 8).

As the retreat member 142 further retreats by the second distance, the clamp plate 131 connected to the retreat member also further retreats by the second distance. As a result, this means that the gap between the wheel assembly 132 and the clamp plate 131 is increased and the clothes are released.

The clothes release of the clamp assembly 130 by the retreat of the retreat member 142 is meaningful in that it is not a simple vertical gap increase. That is, the vertical gap increase between the wheel assembly 132 and the clamp plate 131 means that the clothes are pulled out only when the clothes or the clamp assembly 130 moves additionally forward and backward. However, the front and rear gap increase between the wheel assembly 132 and the clamp plate 131 by the retreat of the retreat member 142 naturally release and drop the clothes without additional movement of the clothes or the clamp assembly 130. That is, as the retreat member 142 and the clamp plate 131 retract together, the lower side of the wheel assembly 132 is opened to the first folding layer 210.

The guide groove 1421 can obtain an area for the second distance movement of the retreat member 142. A first distance movement state of the retreat member 142 may correspond to a state where the guide protrusion 154 is positioned at a rear end 142122 of the second guide groove 14212, and a second distance movement state may correspond to a state where the guide protrusion 154 is positioned at a front end 142121 of the second guide groove 14212.

A relative movement between the retreat member 142 and the wheel case 133 may be performed by an elastic member 1422 and a catching portion 145. The catching portion 145 is provided on the rail frame 141. After the retreat member 142 and the wheel case 133 move the first distance, they are caught by the wheel case 133 and the wheel case 133 cannot move further inward. The elastic member 1422 is provided between the wheel case 133 and the retreat member 142 in order to provide a tensile force by connecting the two components to each other. The retreat member 142 continues to receive an inward force by a slide actuator 143 so that the elastic member 1422 is tensioned. As a result, the wheel case 133 moves the first distance by the catching portion 145, and the retreat member 142 moves the second distance. The elastic member 1422 compensates for the distance difference between the distances.

Referring back to FIGS. 9 and 10, as the clothes are seated on the first folding layer 210, the transport roller 151 ascends again, and the retreat member 142 moves forward again. As the transport roller 151 ascends, the folding process is performed while the clothes are seated on the first folding layer 210 only by gravity and moves. When the transport roller 151 ascends before the center of gravity of the clothes reaches the first folding layer 210, there is a possibility that the clothes may be separated again to the outside. Accordingly, the first folding layer 210 includes a sensor that detects the position of the clothes, thereby controlling the transport roller 151 to ascend (FIG. 10) after the clothes sufficiently move (FIG. 9).

Figure 20:
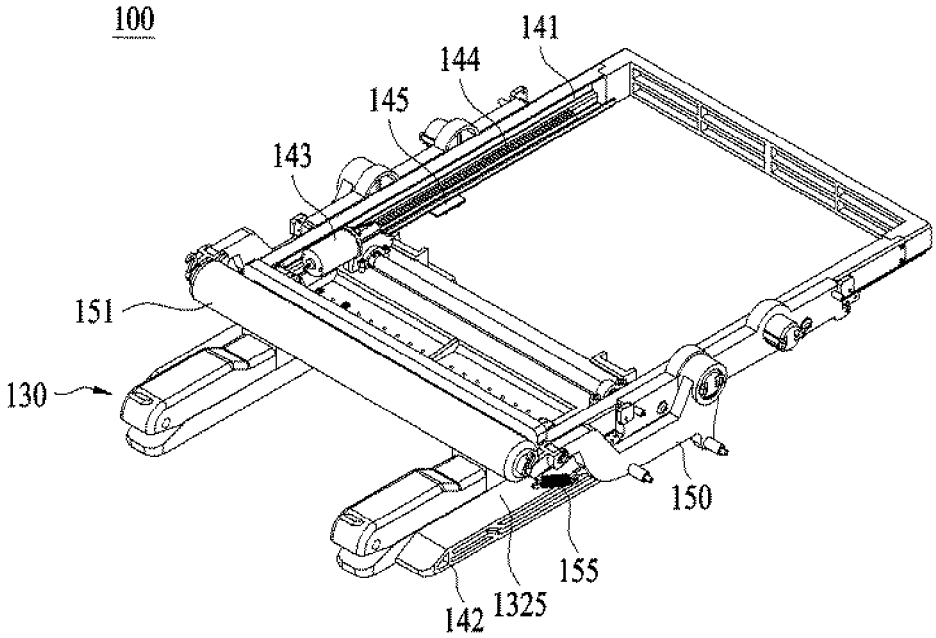
FIGS. 20 to 22 show a combined perspective view and an exploded perspective view of portions of the loading assembly according to the first embodiment of the present disclosure.
Figure 21:
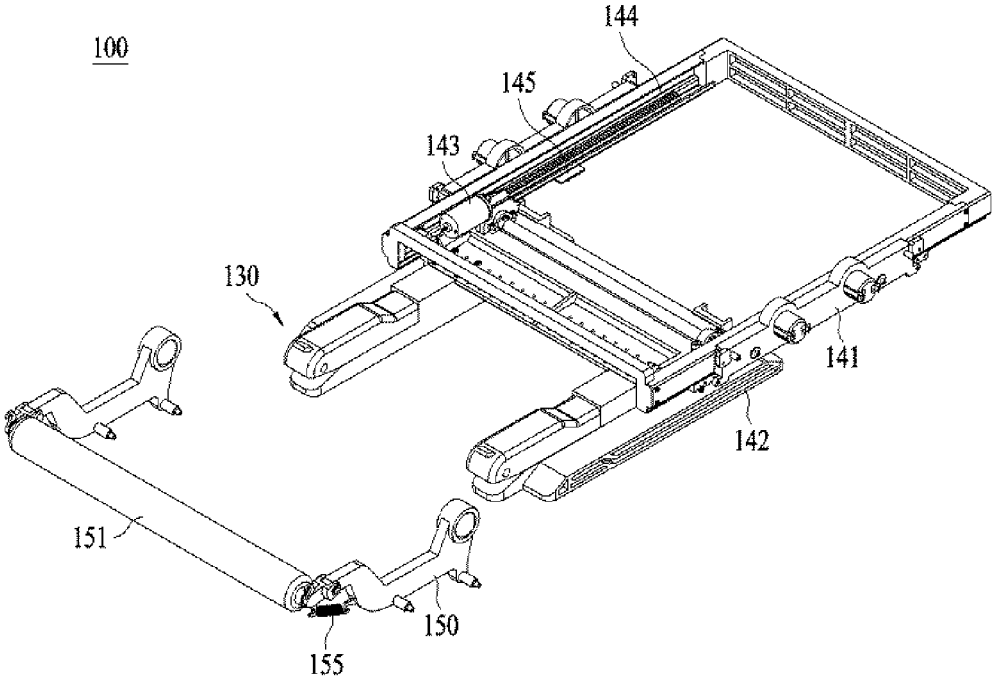
Figure 22:
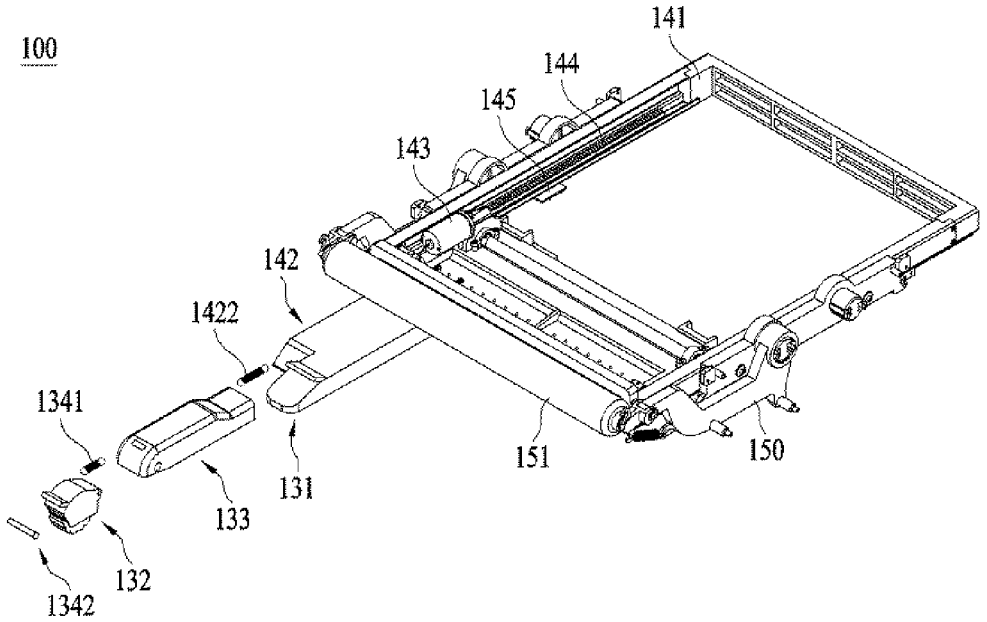

FIGS. 20 to 22 show a combined perspective view and an exploded perspective view of portions of the loading assembly 100 according to the first embodiment of the present disclosure.

In summary, the loading assembly 100 largely includes the clamp assembly 130, the rail frame 141 which is fixed to the frame 110 of the clothes folding device 10 and in which the clamp assembly 130 relatively moves, and the roller link 150 which connects the clamp assembly 130 and the rail frame 141.

The clamp assembly 130 including the wheel assembly 132 may be provided in the form of a pair in a direction perpendicular to the moving direction of the clothes and fixes two points of the clothes. It goes without saying that the clamp assembly 130 can be provided in a single form or can be provided more if necessary.

As described above, the retreat member 142 forms a structure in which the retreat member 142 moves slidingly forward and backward with respect to the rail frame 141 that is a counterpart fixed on the clothes folding device 10. The retreat member 142 may be moved by a driving force generated by the slide actuator 143 including a motor 30. More specifically, the retreat member 142 is provided with the motor 30, and the rail frame 141 is provided with a rail in the form of a rack gear 144. Said both components may operate in association with each other by the counterpart gear provided on the retreat member 142.

The roller link 150 is a component of the loading assembly 100 and mounts the transport roller 151.

A roller spring 155 is a component of the loading assembly 100 and prevents the pushed-in clothes from easily pulled out again by the unlimited rotation of the transport roller 151. In order to implement this, the roller spring 155 connects the roller link 150 and a point eccentric with respect to the rotational axis of the transport roller 151, so that restrictions can be placed such that a force is required to some degree so as to rotate the transport roller 151 in the above-described direction.

Figure 23:
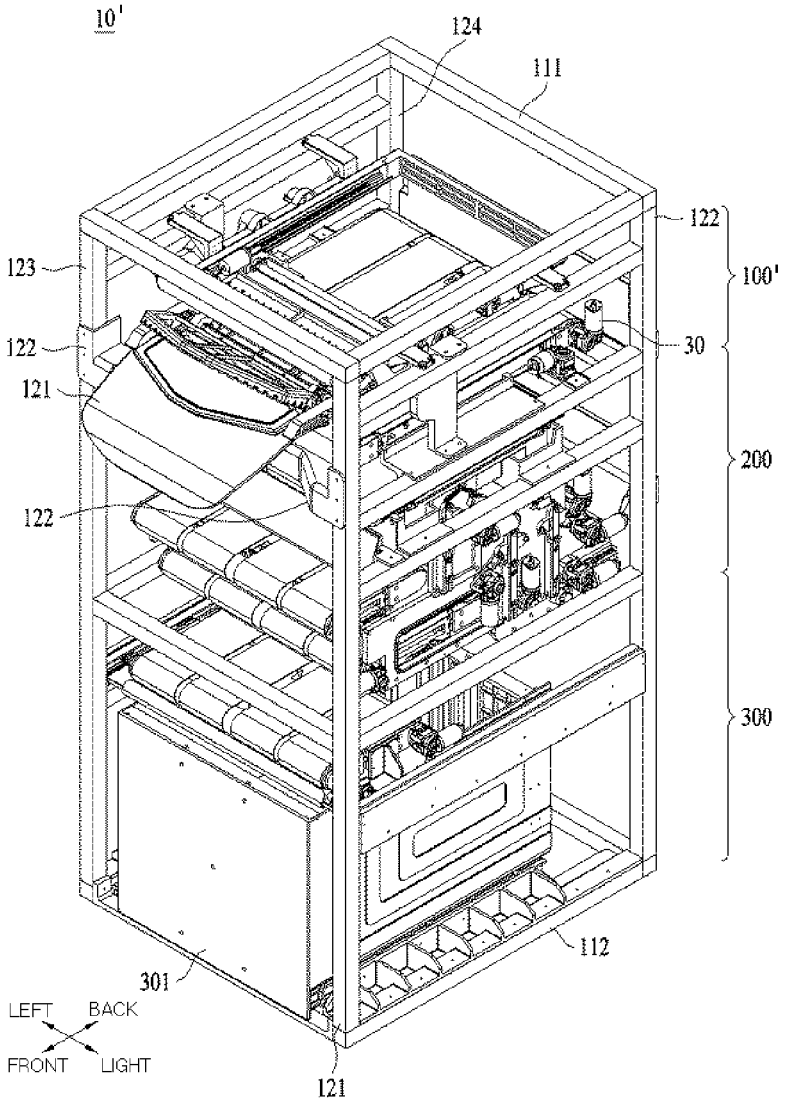
FIG. 23 is a perspective view of a clothes folding device according to the second embodiment of the present disclosure.
Figure 24:
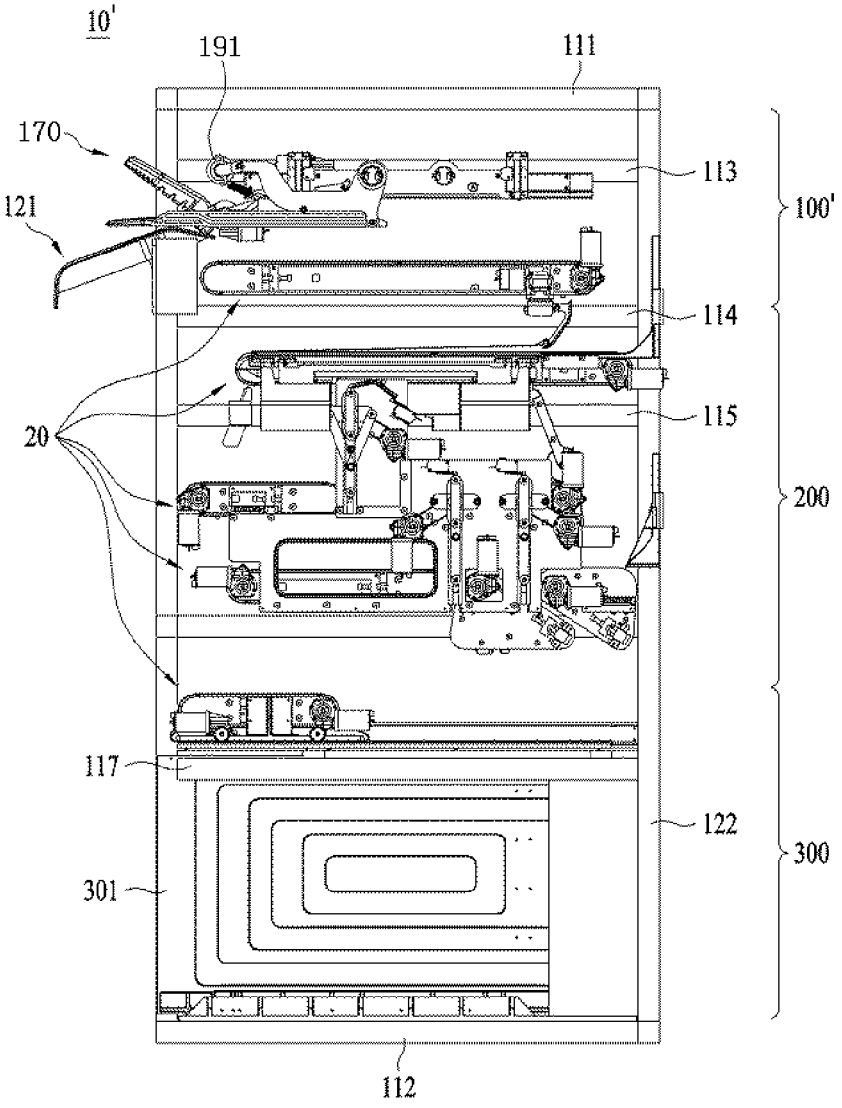
FIG. 24 is a side view of the clothes folding device of FIG. 23.
Figure 25:
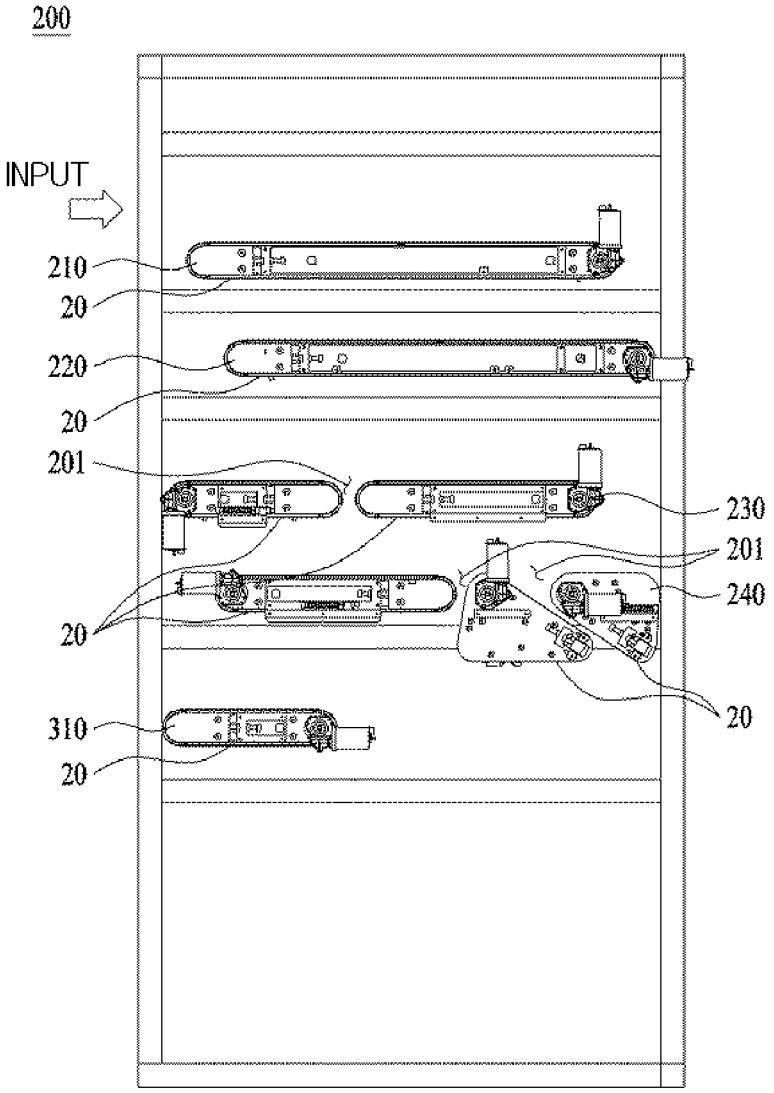
FIG. 25 is a side view of the clothes folding device, which shows a configuration of a folding assembly in the second embodiment of the present disclosure.

Hereinafter, a clothes folding device 10' according to a second embodiment of the present disclosure will be described based on the descriptions of FIGS. 23 to 25. FIG. 23 is a perspective view of the clothes folding device 10' according to the second embodiment of the present disclosure, FIG. 24 is a side view of the clothes folding device 10' of FIG. 23. FIG. 25 is a side view of the clothes folding device 10', which shows a configuration of a folding assembly 200 in the second embodiment of the present disclosure.

Referring to FIGS. 23 to 24, the clothes folding device 10' according to the second embodiment of the present disclosure may be supported and installed in a frame 110. The frame 110 may function as an external skeleton of the clothes folding device 10'. The frame 110 is disposed at the outer edge of the clothes folding device 10' and defines a minimum working space of the clothes folding device 10', and can stably attach and support various members constituting the clothes folding device 10'.

The frame 110 includes an upper frame 111, a lower frame 112, and horizontal frames 113, 114, 115, 116, and 117. The frame 110 includes vertical frames 121, 122, 123, and 124 disposed vertically to support the upper frame 111, the lower frame 112, and the horizontal frame (see FIG. 23).

A finish cover (not shown) may be stably attached to the outer surface of the frame 110. The finish cover may form an exterior of the clothes folding device 10'.

Referring to FIGS. 23 to 24, the clothes folding device 10' includes a loading assembly 100', a folding assembly 200, and an unloading assembly 300.

The loading assembly 100', the folding assembly 200, and the unloading assembly 300 may be supported by the frame 110. In addition, working spaces of the loading assembly 100, the folding assembly 200, and the unloading assembly 300 may be defined by the frame 110.

For example, the working space of the loading assembly 100' may be defined by the upper frame 111 and the horizontal frame 114, and the working space of the unloading assembly 300 may be defined by the horizontal frame 116 and the lower frame 112.

The loading assembly 100' is provided such that clothes are pushed in. The loading assembly 100' may be provided such that the pushed-in clothes can be placed on the upper surface of a conveyor 20. Specifically, the loading assembly 100' may be placed on the upper surface of the conveyor 20 of a first folding layer 210 between the upper frame 111 and the horizontal frame 114.

Here, the term "clothes" refers to a top or bottom made of natural or synthetic fibers that can be worn by humans, and also includes any article that can be provided folded to a desired size and thickness through the clothes folding device, such as a towel or blanket.

A plurality of conveyors 20 may be supported by horizontal frames 113, 114, 115, 116, and 117.

The unloading assembly 300 loads the clothes discharged by the folding assembly 200. The unloading assembly 300 may be provided such that the folded clothes are discharged from the folding assembly 200 and primarily transported to an unloading layer 310, and are loaded in a discharge portion 301 from the unloading layer 310. The folding assembly 200 is provided such that the pushed clothes are folded while being transported. The folding assembly 200 includes at least two folding layers such that the pushed-in clothes are folded to a certain size and shape while being transported. The at least two folding layers are placed above and below and are spaced apart from each other. As the pushed-in clothes are transported from the upper folding layer to the lower folding layer, folding occurs at least once in each folding layer, and as a result, the clothes which have been folded to a certain size and shape are collected by the unloading assembly 300.

As in the embodiment of FIG. 25, the folding assembly 200 may include four folding layers 210, 220, 230, and 240. The four folding layers 210, 220, 230, and 240 may be placed above and below and are spaced apart from each other. As the pushed-in clothes are transported from the first upper folding layer 210 to the fourth lower folding layer 240, the four folding layers function to cause the pushed-in clothes to be folded to a certain size and shape. The folding occurs at least once in each folding layer. In particular, the folding may occur twice in the fourth folding layer 240.

The folding layers 210, 220, 230, and 240 are responsible for seating, transporting, and folding clothes. Each of the folding layers 210, 220, 230, and 240 is provided with at least one conveyor 20 to perform the functions described above, in particular transporting and folding. In particular, the clothes are folded by being inserted into two adjacent conveyors 20 on one folding layer. This is implemented such that the clothes can be folded or can pass while being folded, by a folding gap 201 between two adjacent conveyors 20 on one folding layer.

As in the embodiment of FIG. 25, the four folding layers 210, 220, 230, and 240 may include at least one conveyor 20. The third folding layer 230 may include two conveyors 20, and the fourth folding layer 240 may include three conveyors 20. The folding gap 201 may be formed between the two conveyors provided in the third folding layer 230 in order to allow the clothes to pass through while being folded. Two folding gaps 201 may be formed between the three conveyors provided in the fourth folding layer 240 in order to allow the clothes to be folded or to pass through while being folded.

When the clothes completely pass through the folding gap 201, folding and discharging to the lower layer are simultaneously performed. When the clothes are inserted into the folding gap 201 and pulled out again, only folding can be performed.

As in the embodiment of FIG. 25, the clothes are vertically folded in one folding layer 220 of the four folding layers constituting the folding assembly 200 (more precisely, the folding layer 220 is limited to the secondary vertical folding, and the primary vertical folding is performed by the loading assembly 100'), and the clothes may be horizontally folded in the lower two folding layers 230 and 240.

Here, the horizontal folding means that the clothes are folded with respect to a reference line perpendicular to a proceeding direction of the clothes. The direction perpendicular to the proceeding direction of the clothes is not limited to an exact angle of 90 degrees between the proceeding direction of the clothes and a folding line of the clothes, and includes an error range of 0 to 30 degrees.

Here, the vertical folding means that the clothes are folded with respect to a reference line parallel to the proceeding direction of the clothes. The direction parallel to the proceeding direction of the clothes is not limited to an exact angle of 0 degree between the proceeding direction of the clothes and a folding line of the clothes, and includes an error range of 0 to 30 degrees.

Hereinafter, the structure and function of the loading assembly 100' will be described in detail.

Meanwhile, the above-described clothes folding device 10 according to the first embodiment of the present disclosure and the clothes folding device 10' to be described below according to the second embodiment of the present disclosure may have the same configuration except for the respective loading assemblies 100 and 100'. In addition, it can be understood that components having the same reference number among detailed configurations of the respective loading assemblies 100 and 100' have the same shape.

FIGS. 26 to 31 show sequential operations of the loading assembly 100' according to the embodiment of the present disclosure.

The loading assembly 100' serves to seat the clothes input to the clothes folding device 10' on the first folding layer 210 equipped with an initial conveyor 20. The seating process of the clothes will be briefly described as follows based on the clothes.

Figure 26:
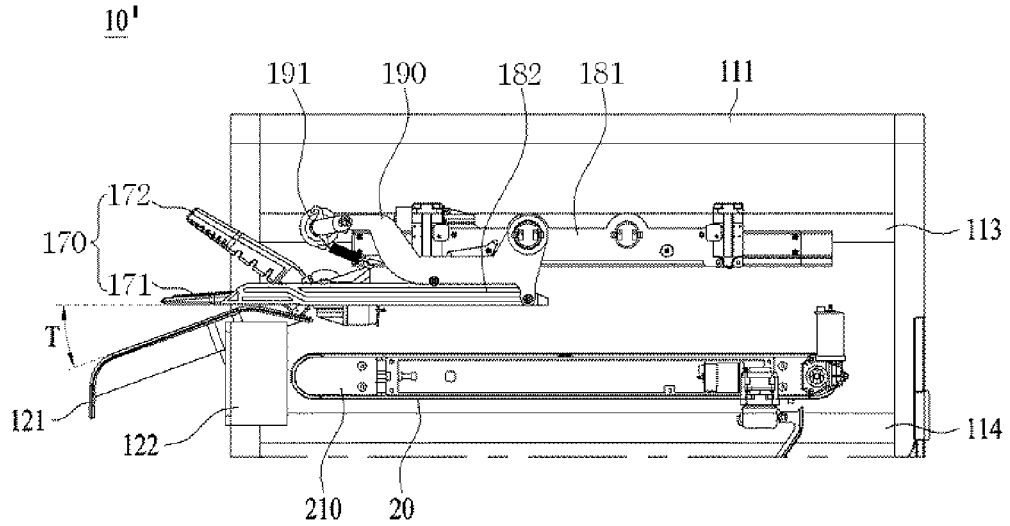
FIGS. 26 to 31 show sequential operations of a loading assembly according to the second embodiment of the present disclosure.
Figure 27:
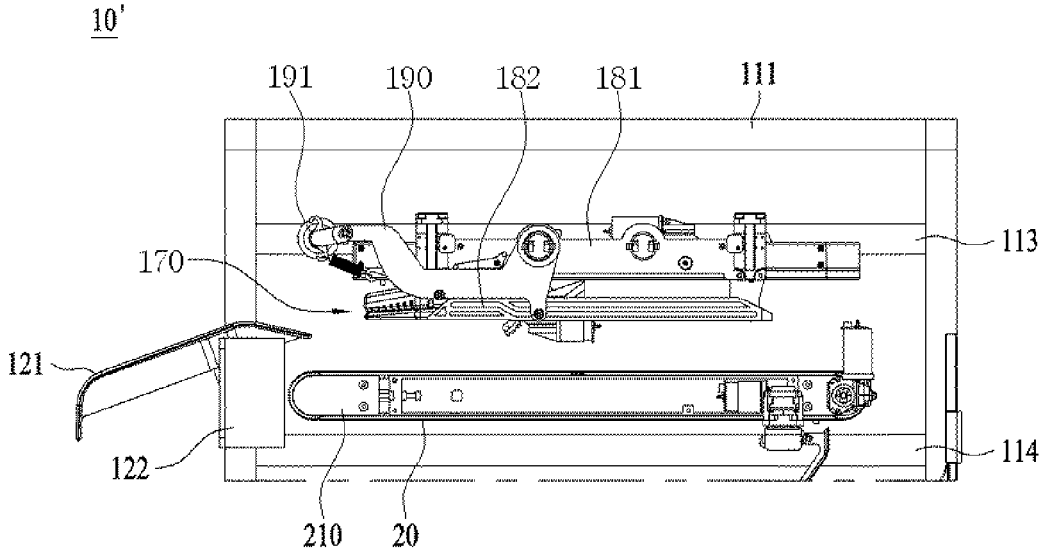
Figure 28:
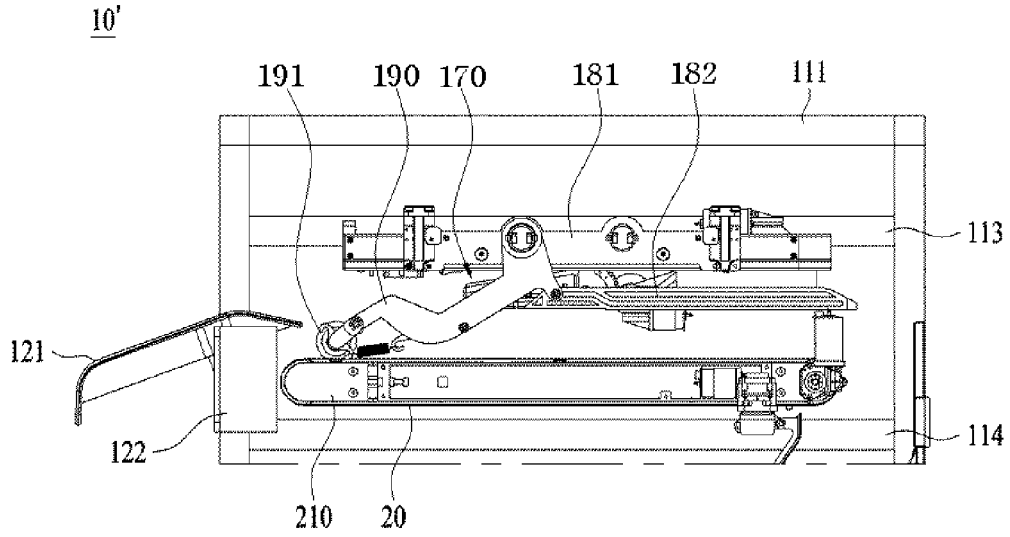
Figure 29:
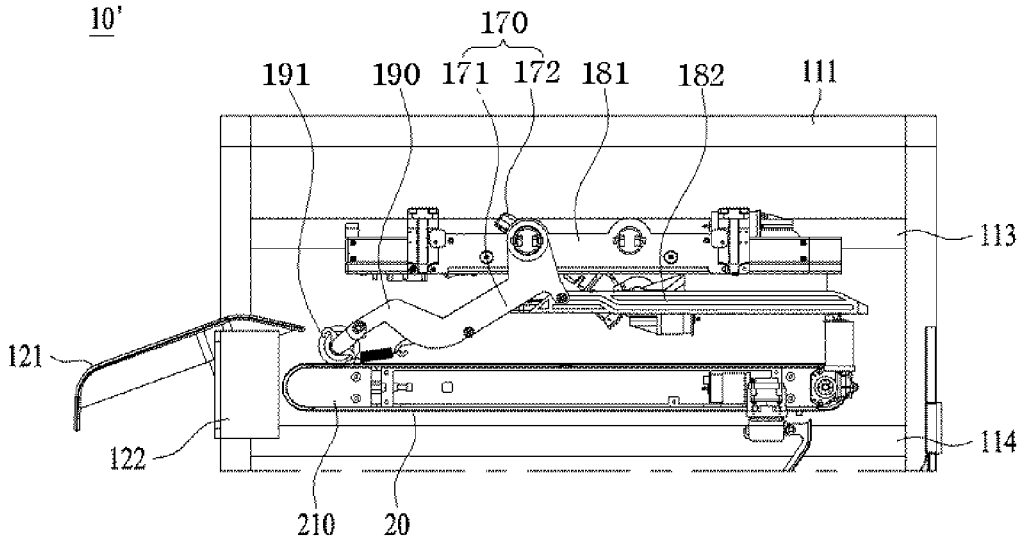
Figure 30:
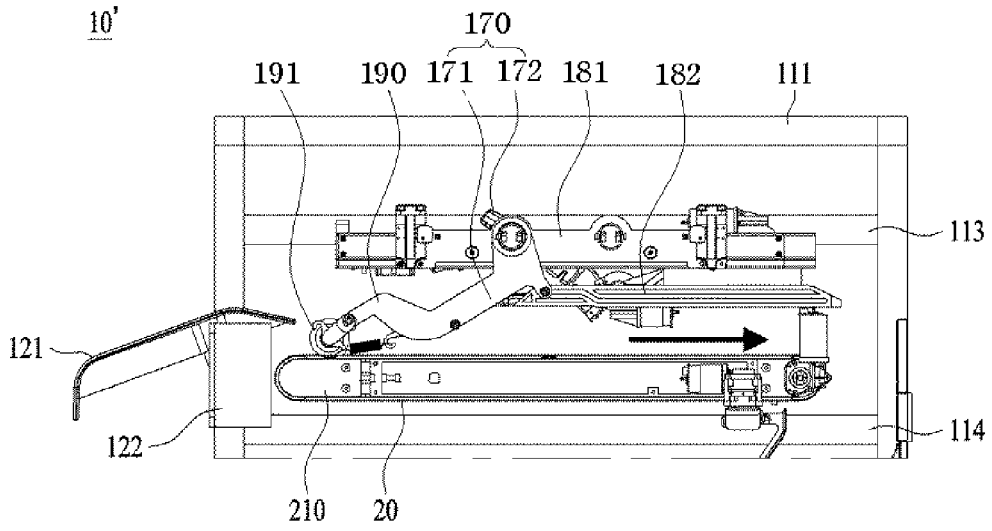
Figure 31:
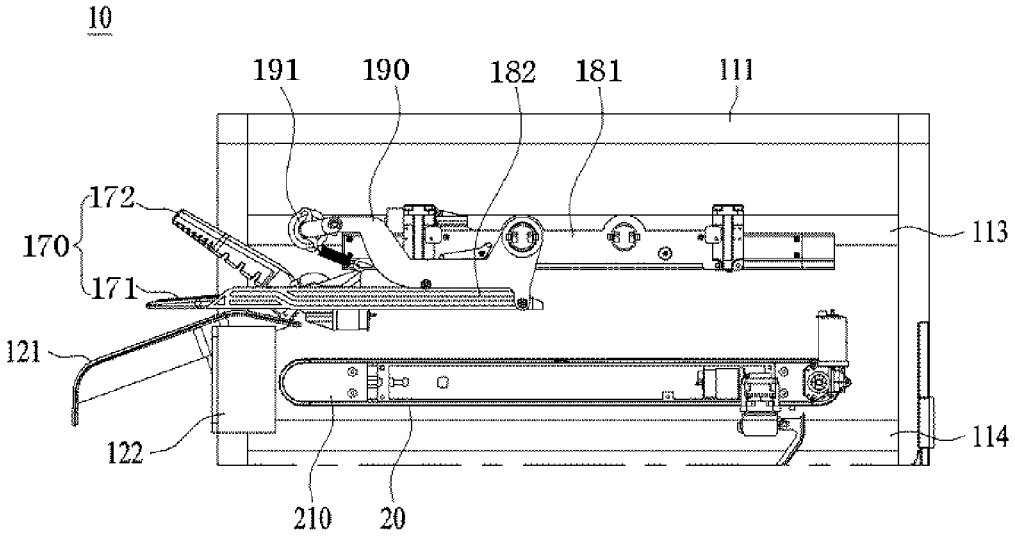

A first step in which the clothes are fixed to a clamp assembly 170 in a state where the clothes are seated on a seating plate 121 (see FIG. 26);

A second step in which the clothes are moved by the clamp assembly 170 while being fixed to the clamp assembly 170 and are vertically primarily folded in the moving process (see FIG. 27);

a third step in which the clothes are seated on the first folding layer 210 (see FIG. 27);

a fourth step in which the clothes are fixed to the first folding layer 210 by a transport roller 191 (see FIG. 28);

a fifth step in which the fixing of the clamp assembly 170 is released (see FIG. 29);

a sixth step in which the clothes are moved a certain distance by the first folding layer 210 (see FIG. 30);

A seventh step in which the fixing of the transport roller 191 is released (see FIG. 31).

The above-described order may be applied differently if necessary. In particular, adjacent steps may be performed simultaneously.

Hereinafter, characteristics applied to the above-described steps will be described in more detail.

Figure 32:
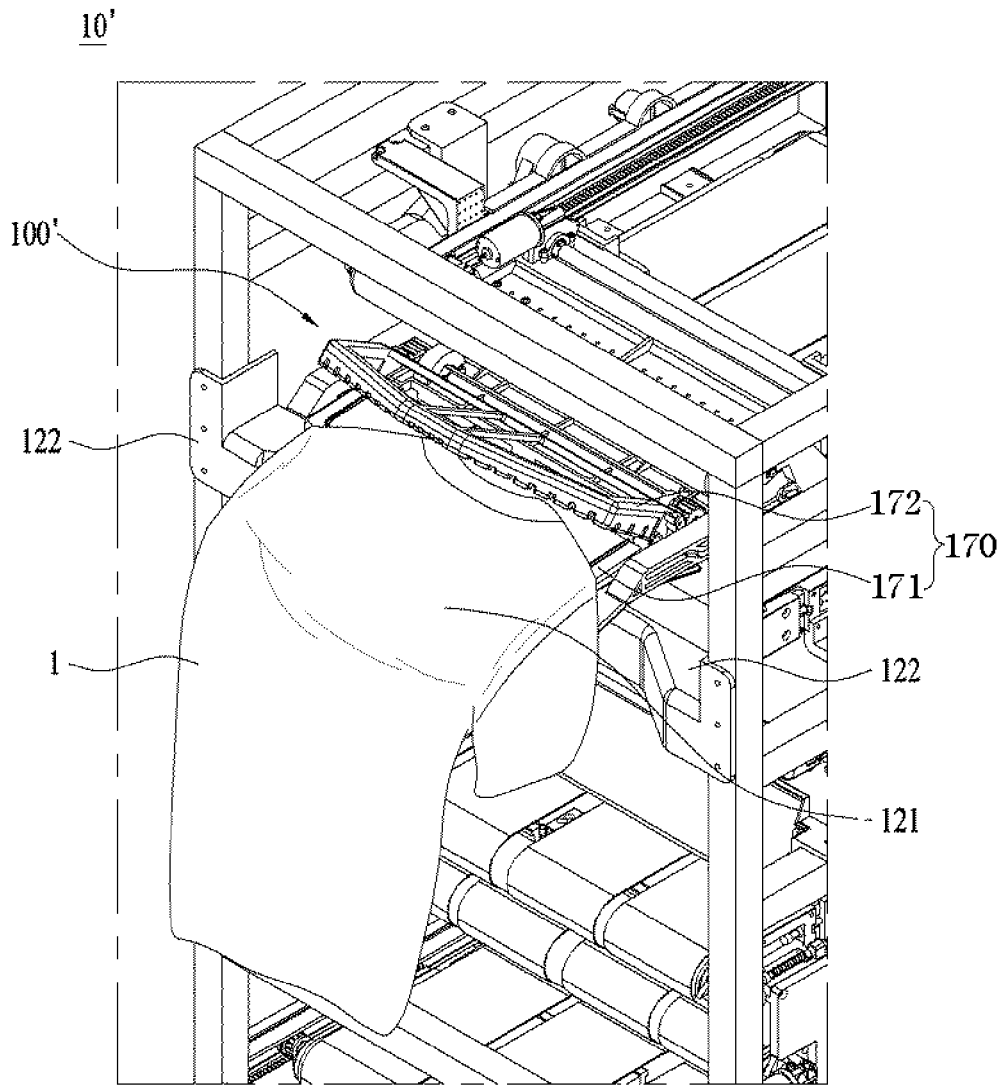
FIG. 32 shows that the clothes folding device according to the second embodiment of the present disclosure in a state where clothes 1 are mounted on a seating plate in order that the clothes are input.

FIG. 32 shows that the clothes folding device 10' according to the second embodiment of the present disclosure in a state where clothes 1 are mounted on the seating plate 121 in order that the clothes 1 are input.

The seating plate 121 serves to cause the clothes 1 to be preliminarily mounted before the clothes 1 are input to the clothes folding device 10'. The seating plate 121 has its width less than left and right widths of the clothes 1, particularly an upper portion of the clothes, so that the remaining portion of the clothes 1 hangs down by gravity.

A primary vertical folding guide 122 is provided symmetrically on both lower left and right sides of the seating plate 121. A portion of the left and right areas of the clothes 1, particularly, of the area not in contact with the seating plate 121 comes into contact with the primary vertical folding guide 122. Then, as the clothes 1 moves into the device, the clothes are folded behind the area in contact with the seating plate 121, so that the primary vertical folding is performed.

Here, the seating plate 121 may form a surface which is inclined downward at an inlet side of the loading assembly by an angle of T (see FIG. 26). Considering that clothes, especially a top, is shaped and sewn based on a three-dimensional state where a wearer wears the top, it can be expected that the seating plate 121 with the inclined surface at the inlet side is less wrinkled than the seating plate 121 with a horizontal plane shape. Even actual experimental results show that the least amount of wrinkles occur in the top of the clothes inclined by an angle of 15° to 25° with respect to a horizontal plane is least wrinkled.

Figure 33:
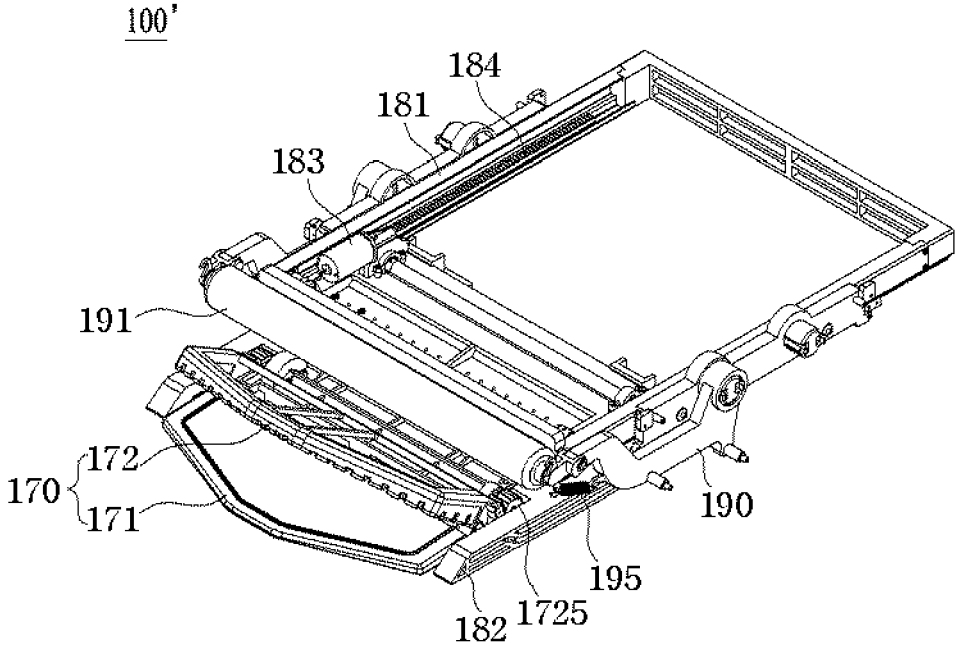
FIGS. 33 and 34 are front perspective views respectively showing states before and after a clamp assembly is opened and closed in accordance with the second embodiment of the present disclosure.
Figure 34:
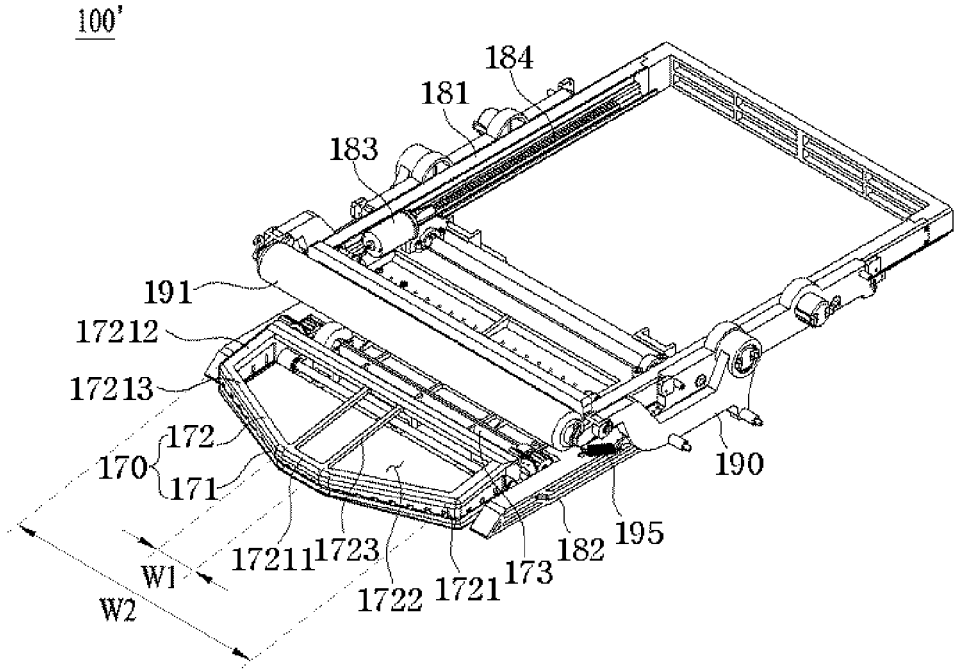
Figure 35:
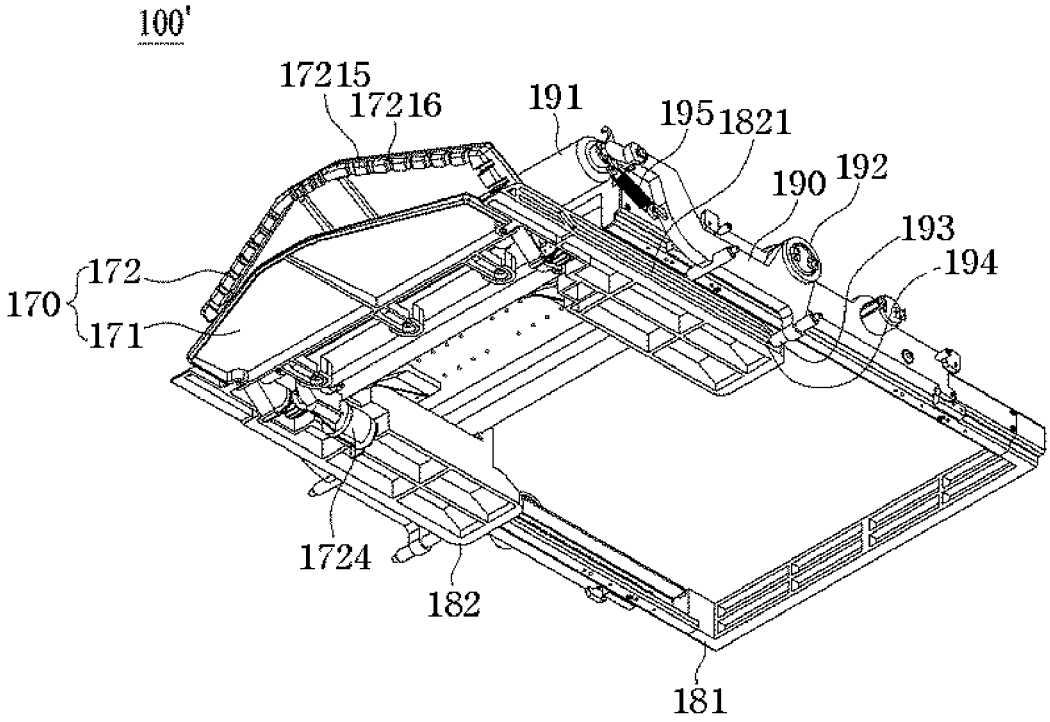
FIG. 35 is a rear perspective view of the clamp assembly according to the second embodiment of the present disclosure.
Figure 36:
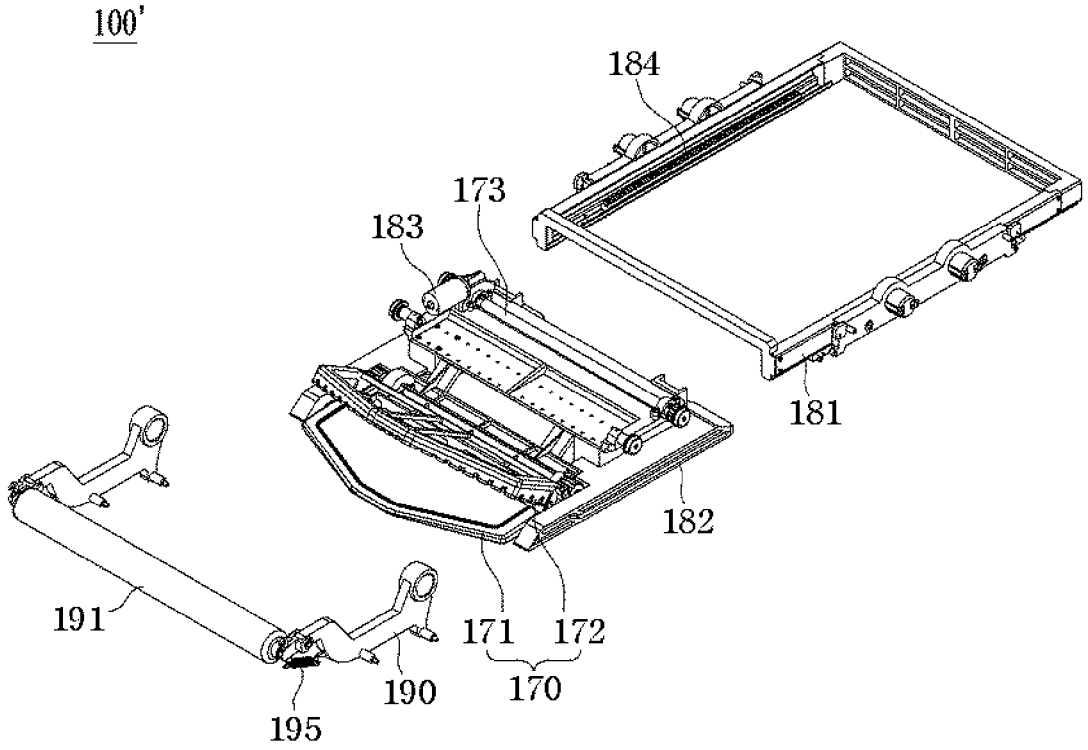
FIG. 36 is an exploded perspective view of FIG. 33.

FIGS. 33 and 34 are front perspective views respectively showing states before and after the clamp assembly 170 is opened and closed in accordance with the second embodiment of the present disclosure. FIG. 35 is a rear perspective view of the clamp assembly 170 according to the second embodiment of the present disclosure. FIG. 36 is an exploded perspective view of FIG. 33.

The loading assembly 100' largely includes the clamp assembly 170, the rail frame 141 in which the clamp assembly 170 relatively moves, and a roller link 190 which connects the clamp assembly 170 and a rail frame 181.

The clamp assembly 170 fixes the inserted clothes and moves the clothes inward. The clamp assembly 170 includes a clamp plate 171 and a pressing member 172. The clamp plate 171 presses the inserted clothes from both sides.

The clamp plate 171 and the pressing member 172 rotate with each other to be opened and receive the clothes, and are closed in the state where the clothes are received, so that the clothes are fixed. The clamp plate 171 and the pressing member 172 which implement the rotating opening/closing method may behave in the same manner as the opening and closing of the teeth of human body. A rotation shaft 173 of a coupled body of the clamp plate 171 and the pressing member 172 is formed in the left and right directions of the clothes folding device, and the clamp plate 171 and the pressing member 172 form a U-shaped outer boundary. The two members 171 and 172 having the U-shaped outer boundary are opened and closed around the rotation shaft 173 to perform an operation as if the mouth is opened and closed.

Unlike the type of fixing the clothes by pressing two points of the clothes, the clamp assembly 170 having such a tooth structure fixes the clothes by pressing a wide area of the clothes, so that the force for fixing the clothes is distributed. This distribution of the force causes less damage to the clothes and makes it possible to perform the fixing of the clothes more stably.

The pressing member 172 includes a pressing portion 1721, and the pressing portion 1721 may be formed along an outer border of the pressing member 172 such that an opening 1722 may be formed within the pressing portion. The pressing portion 1721 may press the clothes along a periphery of a neck hole of the clothes in the form of a band, and a collar of the clothes, such as a shirt, may be exposed through the opening 1722. As the collar of the clothes is exposed through the opening 1722, the collar is not wrinkled even when the clothes are fixed by the clamp assembly 170.

The pressing member 172 further includes a reinforcing member 1723 that connects the top and bottom or left and right of the pressing portion 1721. Thus, the pressing member 172 maintains the rigidity of the pressing member 172.

The pressing portion 1721 may have a left and right symmetrical shape in which an inner left-right width is greater than an outer left-right width. For example, the pressing portion 1721 may be implemented by a plurality of straight portions. The pressing portion 1721 may have an inverted trapezoidal shape including a first straight portion 17211 of which a front end extends in the left and right direction, a second straight portion 17212 of which both left and right sides extend in the front-rear direction, and a third straight portion 17213 which forms an inclination by connecting the first straight portion 17211 and the second straight portion 17212. The pressing portion 1721 having different left and right widths has an advantage of being able to fix the clothes by pressing a wide area of the clothes irrespective of the width.

In addition, unlike the structure with a normal clamp shape, how much the clothes are inserted into the clamp assembly 170 can be varied according to the length of clothes, etc. For example, it is possible to insert more and fix front and rear long clothes and to insert less and fix short clothes. Through this, the structural efficiency of the clothes folding device 10' can be improved.

In order to guide an appropriate degree of insertion according to the clothes or the length of the clothes, the pressing member 172 or the like may be provided with an indicator line. For example, a plurality of indicator lines may be provided which guides the clothes such that the clothes can be fixed by being inserted deep inside the pressing member 172 or by being inserted even a little.

The pressing member 172 may be formed of an elastic material to minimize damage to clothes which may occur due to the fixing of the clamp assembly 170. For example, the pressing member 172 may include a rubber material.

In particular, the pressing portion 1721 may include a plurality of protrusions 17215 arranged to be spaced apart from each other to form repetitive separation areas. The plurality of protrusions 17215 increases a frictional force of a pressing area, and thus, increases the force causing the clothes to be fixed. The plurality of protrusions 17215 are separated by gaps 17216 formed between adjacent protrusions 17215. By means of the plurality of protrusions 17215 and gaps 17216, the pressing member 172 is formed to have a structure closer to the tooth structure described above.

A pressing plate has a plate-like shape and has a shape corresponding to the shape of the pressing member 172, so that the pressing member 172 presses the clothes and provides a counterpart to which the clothes can be fixed.

The opening and closing of the clamp assembly 170 which rotates about the rotational axis may be implemented through an opening and closing actuator 1724 including a motor. An opening and closing signal of the opening and closing actuator 1724 may be generated by a proximity sensor detecting the approach of clothes or the approach of a user, or may be generated by a user's manual input.

The motor may be opened and closed by applying a rotational force to one side of the pressing member 172 and the clamp plate 171 which are engaged in the form of a gear 1725. Here, said both members may be rotated in engagement in the structure of the spur gear 1725. The structure of the spur gear 1725 has an advantage of being capable of transferring a direct and reliable force through a simple shape. The spur gear 1725 may be provided on both left and right sides of the clamp assembly 170.

Figure 37:
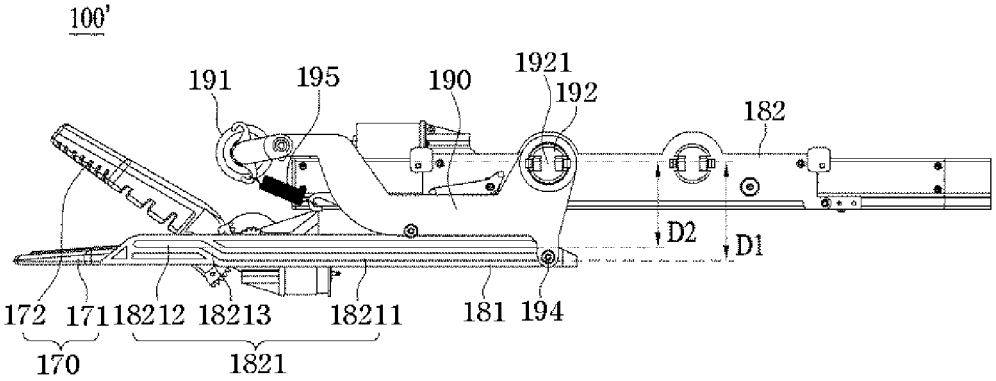
FIGS. 37 and 38 are side views showing states before and after a loading guide 182 retreats in the loading assembly 100' according to the second embodiment of the present disclosure.
Figure 38:
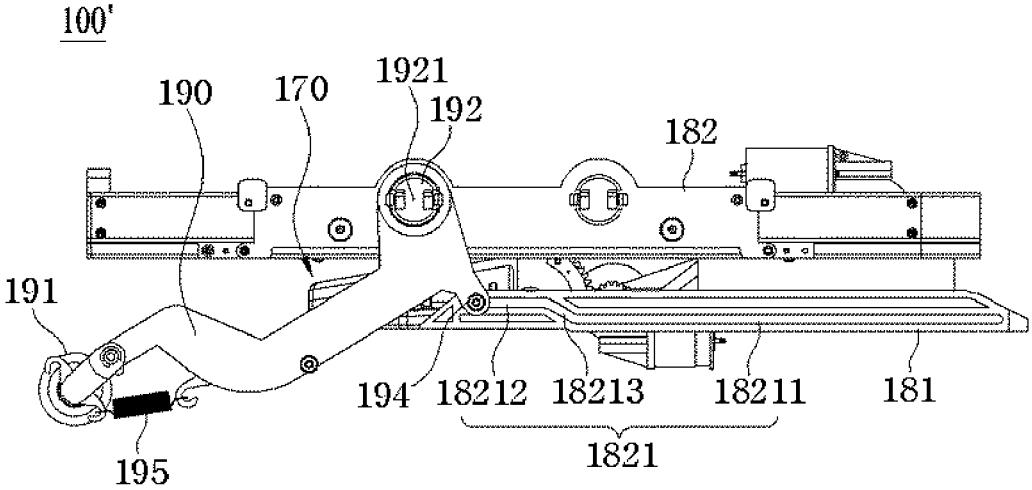

FIGS. 37 and 38 are side views showing states before and after a loading guide 182 retreats in the loading assembly 100' according to the second embodiment of the present disclosure.

The loading guide 182 is a component of the loading assembly 100' and moves the clamp assembly 170 inward. The loading guide 182 may be formed to extend to the rear of the clamp assembly 170, in particular, the clamp plate 171. Accordingly, the forward and backward movements of the loading guide 182 and the clamp assembly 170 are dependent on each other.

More specifically, the loading guide 182 forms a structure in which the loading guide 182 moves slidingly forward and backward with respect to the rail frame 181 that is a counterpart fixed on the clothes folding device. The loading guide 182 may be moved by a driving force generated by a slide actuator 183 including a motor. More specifically, the loading guide 182 is provided with a motor, and the rail frame 181 is provided with a rail in the form of a rack gear 184. Said both components may operate in association with each other by the counterpart gear provided on the loading guide 182.

It is preferable that, when the transport roller 191 descends, the loading guide 182 should move enough to press the clothes to the first folding layer 210 without being caught by the clamp assembly 170.

The roller link 190 is a component of the loading assembly 100', and mounts the transport roller 191.

In particular, the roller link 190 may be provided to be rotatable with respect to the rail frame 181 according to the forward and backward movement of the clamp assembly 170 and the loading guide 182. That is, when the clamp assembly 170 moves inward and backward, the transport roller 191 rotates to descend, and conversely, when the clamp assembly 170 moves outward and forward, the transport roller 191 rotates to ascend. This dependent structure is effective in that it can be implemented without a separate actuator for moving the transport roller 191.

An example for implementing such a mechanism is provided. The roller link 190 has a rotation fastener 192 that is rotatably fastened to the rail frame 181 at one point of the roller link, and a slide fastener 193 that is slidably fastened to the loading guide 182 at the other point of the roller link. At least one side of the loading guide 182 is provided with a guide groove 1821, and the roller link 190 is provided with a guide protrusion 194 that can move along the guide groove 1821, so that they can be slide-fastened.

The guide groove 1821 may form an area forming two different distances from a rotation fastening point 1921 for the rotation of the roller link 190. When the guide protrusion 194 is positioned in a first guide groove 18211 at a longer distance D1 from the rotation fastening point 1921, the roller link 190 is in a first rotation angle state where the transport roller 191 ascends, when the guide protrusion 194 is positioned in a second guide groove 18212 at a shorter distance D2 from the rotation fastening point 1921, the roller link 190 is in a second rotation angle state where the transport roller 191 descends. In the second rotation angle state, the transfer roller 191 may be positioned at an angle at which the clothes seated on the first folding layer 210 are pressed.

As the loading guide 182 moves forward again, the guide protrusion 194 is positioned in the first guide groove 18211 again, so that the transport roller 191 ascends. As the transport roller 191 ascends, the clothes are seated on the first folding layer 210 only by gravity and moves. When the transport roller 191 ascends before the center of gravity of the clothes reaches the first folding layer 210, there is a possibility that the clothes may be separated again to the outside. Accordingly, the first folding layer 210 includes a sensor that detects the position of the clothes, thereby controlling the transport roller 191 to ascend after the clothes sufficiently move.

An incline groove 18213 connecting obliquely the two guide grooves 1821 is provided between the first guide groove 18211 and the second guide groove 18212, so that the guide projection 194 does not get caught when moving between the first guide groove 18211 and the second guide groove 18212.

A roller spring 195 is a component of the loading assembly 100' and prevents the pushed-in clothes from easily pulled out again by the unlimited rotation of the transport roller 191. In order to implement this, the roller spring 195 connects the roller link 190 and a point eccentric with respect to the rotational axis of the transport roller 191, so that restrictions can be placed such that a force is required to some degree so as to rotate the transport roller 191 in the above-described direction.

It is apparent to those skilled in the art that the present invention can be embodied in other specific forms without departing from the spirit and essential characteristics of the present invention.

The above detailed description should not be construed as restrictive in all respects and should be considered as illustrative. The scope of the present invention should be determined by a reasonable interpretation of the appended claims, and all modifications within the equivalent scope of the present invention are included in the scope of the present invention.

The invention claimed is:

1. A clothes folding device serving to perform folding in a process of transporting clothes, the clothes folding device comprising:

a loading assembly which causes the clothes to be pushed-in and seats the clothes on a first folding layer equipped with a conveyor for transport;

a folding assembly which performs the folding of the clothes while the pushed-in clothes are transported; and an unloading assembly which is disposed below the folding assembly and loads the clothes discharged by the folding assembly;

wherein the loading assembly comprises:

a seating plate which forms an inclined surface at an inlet and allows the clothes to be seated thereon;

a clamp assembly which fixes the clothes and moves the clothes to the first folding layer; and a transport roller which presses the clothes seated on the first folding layer and rotates together with the moving of the clothes while pressing the clothes, and thus, preventing the clothes from being separated, wherein the clamp assembly comprises a wheel assembly and a clamp plate which presses inserted clothes from both sides, and wherein the wheel assembly comprises a unidirectional rotating wheel which rotates together with the inserted clothes.

2. The clothes folding device of claim 1, wherein the clamp assembly further comprises a gap maintaining portion which reduces elastically a gap between the clamp plate and the wheel assembly.

3. The clothes folding device of claim 2, wherein the clamp assembly further comprises:

a wheel cap on which the wheel assembly is mounted rotatably;

a wheel case on which the wheel cap is mounted rotatably;

a first rotation fastener which fastens the wheel cap and the wheel case, with a first point of the wheel cap eccentric from a rotational axis of the wheel assembly as a rotational axis;

a first restoration fastener which is provided at a second point of the wheel cap eccentric from the rotational axis of the wheel assembly; and a second restoration fastener which is provided at a third point of the wheel case, and wherein the gap maintaining portion is formed of a spring and connects the first restoration fastener and the second restoration fastener.

4. The clothes folding device of claim 3, wherein the clamp assembly further comprises a release lever which is formed on the wheel cap and is exposed to an outside of the wheel case.

5. The clothes folding device of claim 3, wherein the loading assembly further comprises a rail frame which provides a counterpart for inward movement of the clamp assembly, and wherein the clamp assembly further comprises:

a retreat member which moves inward a first distance together with the wheel case while being connected to the wheel case, and then is spaced apart from the wheel case, and further moves inward a second distance; and an elastic member which elastically connects the wheel case and the retreat member and provides a tensile force between the wheel case and the retreat member when the retreat member moves the second distance.

6. The clothes folding device of claim 5, wherein the loading assembly further comprises a catching portion which is provided on the rail frame and limits an additional movement of the wheel case when the wheel case moves inward the first distance.

7. The clothes folding device of claim 5, wherein the clamp plate is provided on the retreat member, forms an inclined surface forming upward inclination in a retreat direction, and exposes at least a portion of the wheel in accordance with the second distance moving of the retreat member.

8. The clothes folding device of claim 5, wherein the loading assembly further comprises a roller link which mounts the transport roller and is rotatable with respect to the rail frame in accordance with the inward movement of the of clamp assembly.

9. The clothes folding device of claim 8, wherein the loading assembly further comprises a roller spring which connects the roller link and a point eccentric with respect to a rotational axis of the transport roller.

10. The clothes folding device of claim 8, wherein the loading assembly further comprises:

a guide groove formed in the retreat member; and a guide protrusion which is provided on the roller link, moves along the guide groove, and rotates the roller link.

11. The clothes folding device of claim 10, wherein the guide groove comprises:

a first guide groove which guides a first rotation angle of the roller link; and a second guide groove which guides a second rotation angle of the roller link, and wherein the second rotation angle corresponds to an angle at which the clothes seated on the conveyor are pressed by the transport roller.

12. The clothes folding device of claim 11, wherein a distance from a center of rotation of the roller link to the first guide groove is greater than a distance from the center of rotation of the roller link to the second guide groove, and an incline groove is formed between adjacent ends of the first guide groove and the second guide groove.

13. The clothes folding device of claim 5, wherein the loading assembly further comprises a driving motor which is installed in the rail frame and generates a driving force for the inward movement of the clamp assembly.

14. The clothes folding device of claim 1, further comprising a primary vertical folding guide which is provided on both lower portions of the seating plate separately and performs primary vertical folding when the seated clothes are pushed in.

15. The clothes folding device of claim 1, wherein the inclined surface is inclined at an angle of 15° to 25° with respect to a horizontal plane.

16. The clothes folding device of claim 1, wherein the wheel assembly comprises:

a wheel which forms a friction surface; and a unidirectional bearing which is provided within the wheel.

17. The clothes folding device of claim 1, wherein the wheel assembly is provided in a form of a pair in a direction perpendicular to a moving direction of the clothes and fixes two points of the clothes.

18. A clothes folding device serving to perform folding in a process of transporting clothes, the clothes folding device comprising:

a loading assembly which causes the clothes to be pushed-in and seats the clothes on a first folding layer equipped with a conveyor for transport;

a folding assembly which performs the folding of the clothes while the pushed-in clothes are transported; and an unloading assembly which is disposed below the folding assembly and loads the clothes discharged by the folding assembly, wherein the loading assembly comprises:

a seating plate which forms an inclined surface at an inlet and allows the clothes to be seated thereon;

a clamp assembly which fixes the clothes and moves the clothes to the first folding layer; and a transport roller which presses the clothes seated on the first folding layer and rotates together with the moving of the clothes while pressing the clothes, and thus, preventing the clothes from being separated, wherein the clamp assembly comprises a clamp plate which forms a rotational axis and is provided to be openable and closeable, and a pressing member, and presses and fixes the clothes in a closed state, and wherein the pressing member is provided in a form of teeth.

19. The clothes folding device of claim 18, wherein the pressing member comprises a pressing portion which presses the clothes along a periphery of a neck hole of the clothes in a form of a band.

20. The clothes folding device of claim 19, wherein the pressing portion has a left and right symmetrical shape in which an inner left-right width is greater than an outer left-right width.

21. The clothes folding device of claim 19, wherein the pressing portion is formed along an outer border of the pressing member and forms an opening formed therein, and wherein the opening corresponds to a collar area of the clothes.

22. The clothes folding device of claim 19, wherein the pressing portion comprises a plurality of protrusions arranged to be spaced apart from each other to form repetitive separation areas.

23. The clothes folding device of claim 18, wherein the pressing member is formed of an elastic material.

24. The clothes folding device of claim 18, wherein the pressing member and the clamp plate are rotated in engagement in a structure of a spur gear.

25. The clothes folding device of claim 18, wherein the loading assembly further comprises:

a loading guide which moves the clamp assembly inward; and a rail frame which provides a counterpart for inward movement of the loading guide and forms a rail that guides the inward movement.

26. The clothes folding device of claim 25, wherein the loading assembly further comprises a roller link which mounts the transport roller and is rotatable with respect to the rail frame in accordance with the inward movement of the of clamp assembly.

27. The clothes folding device of claim 26, wherein the loading assembly further comprises a roller spring which connects the roller link and a point eccentric with respect to a rotational axis of the transport roller.

28. The clothes folding device of claim 26, wherein the loading assembly further comprises:

a guide groove formed in the loading guide; and a guide protrusion which is provided on the roller link, moves along the guide groove, and rotates the roller link.

29. The clothes folding device of claim 28, wherein the guide groove comprises:

a first guide groove which guides a first rotation angle of the roller link; and a second guide groove which guides a second rotation angle of the roller link, and wherein the second rotation angle corresponds to an angle at which the clothes seated on the conveyor are pressed by the transport roller.

30. The clothes folding device of claim 29, wherein a distance from a center of rotation of the roller link to the first guide groove is greater than a distance from the center of rotation of the roller link to the second guide groove, and an incline groove is formed between adjacent ends of the first guide groove and the second guide groove.

31. The clothes folding device of claim 18, further comprising a primary vertical folding guide which is provided on both lower portions of the seating plate separately and performs primary vertical folding when the seated clothes are pushed in.

32. The clothes folding device of claim 18, wherein the inclined surface is inclined at an angle of 15° to 25° with respect to a horizontal plane.

* * * * *